US012152450B2

(12) United States Patent
Mehrabian et al.

(10) Patent No.: US 12,152,450 B2
(45) Date of Patent: Nov. 26, 2024

(54) BENCHTOP RIG HYDRAULICS SIMILITUDE

(71) Applicant: The Penn State Research Foundation, University Park, PA (US)

(72) Inventors: Amin Mehrabian, University Park, PA (US); Wei Zhang, University Park, PA (US); Pooya Khodaparast, University Park, PA (US)

(73) Assignee: The Penn State Research Foundation, University Park, PA (US)

( * ) Notice: Subject to any disclaimer, the term of this patent is extended or adjusted under 35 U.S.C. 154(b) by 0 days.

(21) Appl. No.: 18/560,197

(22) PCT Filed: May 25, 2022

(86) PCT No.: PCT/US2022/072554
§ 371 (c)(1),
(2) Date: Nov. 10, 2023

(87) PCT Pub. No.: WO2022/251841
PCT Pub. Date: Dec. 1, 2022

(65) Prior Publication Data

US 2024/0263532 A1 Aug. 8, 2024

Related U.S. Application Data

(60) Provisional application No. 63/202,112, filed on May 27, 2021.

(51) Int. Cl.
*E21B 21/08* (2006.01)
*E21B 47/06* (2012.01)

(52) U.S. Cl.
CPC ..... *E21B 21/08* (2013.01); *E21B 47/06* (2013.01)

(58) Field of Classification Search
CPC ..... E21B 47/06; E21B 21/08
See application file for complete search history.

(56) References Cited

U.S. PATENT DOCUMENTS

2016/0376859 A1 12/2016 Mehrabian et al.
2018/0058992 A1 3/2018 van Oort et al.
(Continued)

OTHER PUBLICATIONS

International Search Report and Written Opinion dated Aug. 3, 2022 for PCT/US2022/072554 filed May 25, 2022.
(Continued)

*Primary Examiner* — Dany E Akakpo
(74) *Attorney, Agent, or Firm* — Buchanan Ingersoll & Rooney PC

(57) ABSTRACT

Embodiments relate to a flow loop system for estimating wellbore circulation density. The flow loop system includes an eccentric annulus structure having an inner eccentric pipe and an outer pipe. The inner eccentric pipe can be representative of a drill string in a wellbore. The outer pipe can be representative of the wellbore. The flow loop system includes a pressure sensor configured to measure pressure loss gradients of annular flows between the inner eccentric pipe and the outer pipe. The flow loop system includes a wellbore circulation density processing module configured to estimate the wellbore's bottomhole pressure based on the measured loss gradients of annular flows of fluid and solid particles, rotation of the inner eccentric pipe, and eccentricity of the inner eccentric pipe.

20 Claims, 7 Drawing Sheets

(56) References Cited

U.S. PATENT DOCUMENTS

| | | | | |
|---|---|---|---|---|
| 2019/0048672 | A1 | 2/2019 | Singh et al. | |
| 2021/0017845 | A1* | 1/2021 | Madasu | G06N 3/084 |
| 2021/0381373 | A1* | 12/2021 | Rahman | G05B 13/024 |

OTHER PUBLICATIONS

Written Opinion of the International Searching Authority dated Aug. 3, 2022 for PCT/US2022/072554 filed May 25, 2022.

* cited by examiner

BENCHTOP RIG HYDRAULICS SIMILITUDE

CROSS-REFERENCE TO RELATED APPLICATIONS

This patent application is the U.S. national stage application of International Patent Application No. PCT/US2022/072554, filed on May 25, 2022, which is related to and claims the benefit of priority to U.S. Provisional Application No. 63/202,112, filed May 27, 2021, the entire contents of which is incorporated herein by reference.

FIELD OF THE INVENTION

Embodiments relate to a flow loop system for estimating circulation density of drilling fluid and drill cuttings in a wellbore, wherein an eccentric annulus structure with rotating inner pipe, along with a wellbore circulation density estimation module, are used to estimate the wellbore's bottomhole pressure based on measured loss gradients of the flow loop system.

Embodiments disclosed herein relate to a hardware, and associated processing module that are aimed at predicting the equivalent circulation density of wellbores. The technology presented herein involve the following. (1) Design and fabrication of a benchtop wellbore hydraulics similitude device (see FIG. 1) of portable size and weight, appropriate for use in laboratory space. The device is intended to provide a scaled-down measurement of the frictional pressure loss gradient along an annular section of an embedded mini-flow loop. (2) A scaling method that enables estimation of the field-scale pressure loss gradients of the wellbore flow in terms of the measured frictional pressure loss gradients along the device flow loop. This method is based on the universal laws of similarity in fluid mechanics. A software can receive the device pressure differential data measured by a set of pressure sensors, apply the developed scaling method on those data, and return the estimated equivalent circulation density (ECD) or simulated bottomhole pressure of the wellbore.

BACKGROUND OF THE INVENTION

Deep subterranean wells are drilled to extract renewable or fossil energy from the subsurface. When drilling such wells, the bottomhole pressure of the drilling fluid that is circulated in the wellbore must be constantly maintained within an allowable range of tolerance—known as the drilling margin of the well. The market demand for extended-reach and narrow-margin drilling has enhanced the need for accurate estimation of the wellbore's bottomhole pressures ahead of the drill bit.

Oil, gas, and geothermal wells enable access to the fossil and renewable energy resources of the subsurface. Ongoing advancements in drilling deviated wells, navigation control, lost circulation control, and high-temperature, high-pressure drilling, particularly in offshore drilling environments, have allowed for reaching deeper energy resources in the subsurface. A key requirement of drilling operations in such environments is the ability to predict the bottomhole pressure ahead of the drill bit. In this aspect, the wellbore equivalent circulation density (ECD) is defined as the bottomhole pressure (p5 in FIG. 2) of the circulating drilling fluid divided by total vertical depth of the wellbore when expressed in density units. The drilling margin—known as the safe window of ECD—in sufficiently deep wells is often narrow. FIG. 2 shows the wellbore pressure and circulation density. Narrow-margin drilling requires estimation of the wellbore ECD with high accuracy to avoid unfavorable drilling events such as wellbore kick, breakout, fracturing, or lost circulation.

State-of-the-art methods of estimating the wellbore ECDs include analytical or numerical solutions to the mechanics of the wellbore annular flow that extends from the drill bit to the surface (1, 2) (point e to a in FIG. 2). The complex rheology of drilling fluid, presence of solid cuttings, as well as the drill pipe rotation and eccentricity, often introduce significant errors in the estimated frictional pressure loss gradients, and therefore the wellbore ECD, when using these methods.

With the advent of narrow margin drilling, accurate estimation of the pressure loss in the annular flow is integral for preventing undesirable drilling events such as lost circulation, wellbore breakout and formation damage. More complicated well designs arising in deepwater, highly inclined, or depleted sand drilling environments require extra degree of accuracy in pressure loss calculations. Flow regime (laminar, transition, or turbulent), geometry (annular diameter ratio, eccentricity), velocity profile, and fluid rheology can all impact the pressure loss. There is therefore a rich body of literature attempting to systematically study the effects of all the important factors in pressure loss calculations.

Friction loss of non-Newtonian fluids in a static (no rotation), concentric annulus within the laminar region can be analytically derived (3-7), though not entirely straightforward since the calculations need either an iterative procedure or a numerical integration to find the zero-shear rate radius, a limitation not addressed until recently (8). In reality, however, the annulus is neither concentric nor static, since the drill-string rotates during operation, thereby inducing a helical flow in the annulus. Escudier listed a bibliography of research papers that focus on these parameters individually, as well as in conjunction (9). The research since then has only been expanded, taking into account further details such as yield stress and partial blockage of the flow (10-13).

Three main methods of resolving the target pressure loss are analytical, numerical, and experimental. Analytical equations often reach complicated points which can only be resolved iteratively or through numerical integration, if at all resolvable. Numerical simulation methods can help with these complicated systems (2,14-18). A more recent survey of research on this topic is given in (19), where they detail the literature based on the three mentioned methodologies before they lay out their proposed discretization method and solve the problem of fully developed flow of non-Newtonian fluid in eccentric annuli. However, they focus only on axial flow, which does not account for inner pipe rotation. Tong et al., (20) solved a similar problem taking into account partial blockage due to drill cuttings. They too ignore inner pipe rotation by assuming crossflow velocities to be negligible.

Whether solved for numerically or analytically, pressure loss calculation results shall always be benchmarked with experiments (21-24). However, with a few exceptions such as the one presented in (25), many experimental works do not accompany a dimensional analysis to determine the main dimensionless parameters necessary to build an inclusive correlation (16; 26-28). Yield-power law (YPL) rheological models have attracted considerable attention in drilling research (18,29-31). Despite their relatively superior prediction of drilling fluid rheology in terms of the flow shear rate, analytical and numerical solutions for annular flow of YPL fluids are rarely reported in the literature.

BRIEF SUMMARY OF THE INVENTION

Embodiments relate to a two-phase flow loop system for estimating wellbore circulation density. The flow loop system includes an eccentric annulus structure having an inner eccentric pipe and an outer pipe. The inner eccentric pipe can be representative of a drill string in a wellbore. The outer pipe can be representative of the wellbore. The flow loop system includes a pressure sensor configured to measure pressure loss gradients of annular flows between the inner eccentric pipe and the outer pipe. The flow loop system includes a wellbore circulation density processing module configured to estimate the wellbore's bottomhole pressure based on the measured loss gradients of annular flows.

Techniques disclosed herein provide a means to obtain the fluid flow rate, particles injection rate, and inner pipe rotation speed of a laboratory flow loop setup so that the experiment can fully mimic the helical flow of the drilling fluid and drill cuttings along the wellbore annulus. For this purpose, dimensional analysis for the drilling fluid flow and drill cuttings in an eccentric annulus with inner pipe rotation is carried out while considering the Newtonian, power-law, and yield power-law fluid rheologies. Based on the Buckingham II theory, the dimensionless variables needed to characterize the described configuration are defined for each fluid rheology based on which the appropriate formulae for key design parameters of lab experiment, i.e., inner pipe speed, fluid flow rate, cuttings injection rate, tested fluid rheology, as well as cuttings size distribution and density, are obtained.

Equivalent circulation density of a fluid circulation system in drilling rigs is determined by the frictional pressure losses in the wellbore annulus. Flow loop experiments are commonly used to simulate the annular wellbore hydraulics in the laboratory. However, proper scaling of the experiment design parameters including the drill pipe rotation and eccentricity has been a weak link in the literature. The techniques disclosed herein use similarity laws and dimensional analysis to obtain a complete set of scaling formulae that relates the pressure loss gradients of annular flows at the laboratory and wellbore scales while considering the effects of inner pipe rotation and eccentricity.

Dimensional analysis is conducted for commonly encountered types of drilling fluid rheology, namely, Newtonian, power-law, and yield power-law. Appropriate dimensionless groups of the involved variables are developed to characterize fluid flow in an eccentric annulus with a rotating inner pipe. Characteristic shear strain rate at the pipe walls is obtained from the characteristic velocity and length scale of the considered annular flow. The relation between lab-scale and wellbore scale variables are obtained by imposing the geometric, kinematic, and dynamic similarities between the laboratory flow loop and wellbore annular flows.

The outcomes of the considered scaling scheme is expressed in terms of formulae that determine the solid particles and fluid phase flow rates, as well as inner pipe rotation speed, of the laboratory experiments in terms of the corresponding wellbore flow rates and drill pipe rotation speed in such a way that the resulting Fanning friction factors of the laboratory and wellbore-scale annular flows become identical. Attaining complete similarity between the flow loop device and wellbore-scale annular flow may require the fluid rheology of the lab experiments to be different from the drilling fluid.

An exemplary embodiment relates to a flow loop system for estimating wellbore bottomhole pressure or circulation density. The system includes an eccentric annulus structure. The eccentric annulus structure has an inner eccentric and rotating pipe as well as an outer pipe. The inner eccentric pipe is representative of a drill string in a wellbore. The outer pipe is representative of the wellbore. The system includes a pressure sensor configured to measure pressure loss gradients of annular flows between the inner eccentric pipe and the outer pipe. The system includes a wellbore circulation density processing module configured to estimate the wellbore's bottomhole pressure based on the measured loss gradients of annular flows, fluid flow rate, particles injection rate, rotation speed of the inner eccentric pipe, and eccentricity of the inner eccentric pipe.

In some embodiments, the wellbore circulation density processing module is configured to use fluid flow rate within the flow loop system and inner eccentric pipe rotation speed to mimic annular flow of drilling fluid in the wellbore and drill pipe rotational speed in the wellbore.

In some embodiments, estimation of the wellbore's bottomhole pressure involves imposing geometric, kinematic, dynamic, and rheological similarities between fluid flow within the flow loop system and annular flow of the wellbore such that Fanning friction factors in the flow loop system are identical to Fanning friction factors in the wellbore.

In some embodiments, the wellbore circulation density processing module is configured to impose geometric, kinematic, dynamic, and rheological similarities simultaneously.

In some embodiments, the eccentric annulus structure comprises: the inner eccentric pipe configured as a rotor; the outer pipe configured as a stator; a pump configured to circulate fluid through the eccentric annulus structure; a variable speed motor in mechanical connection with the inner eccentric pipe; and a feeder configured to inject particulate material into the circulating fluid.

In some embodiments, the particulate material is selected to mimic drill cutting material.

In some embodiments, imposing geometric similarities involves requiring length ratios between fluid flow within the flow loop system and annular flow of the wellbore to be identical.

In some embodiments, requiring length ratios between fluid flow within the flow loop system and annular flow of the wellbore to be identical involves $$\frac{R_{i,L}}{D_{H,L}} = \frac{R_{i,F}}{D_{H,F}}$$

and $$\frac{e_L}{D_{H,L}} = \frac{e_F}{D_{H,F}};$$

and $R_i$ are radii of the inner eccentric pipe and the outer pipe, respectively; e is drill pipe eccentricity; $D_H$ denotes effective hydraulic diameter for fluid flow, wherein $D_H=\alpha(R_o-R_i)$ with $\alpha$ being a dimensionless value between 1 and 2; and L and F denote corresponding parameters of fluid flow within the flow loop system and annular flow of the wellbore, respectively.

In some embodiments, imposing kinematic similarities involves requiring a ratio of velocities attributed to the inner eccentric pipe rotation and the pump flow rate in the flow loop to equate to a ratio of velocities attributed to drill pipe rotational speed in the wellbore and annular flow of drilling fluid in the wellbore.

In some embodiments, requiring the ratio of velocities attributed to the inner eccentric pipe rotation and the pump flow rate to equate to the ratio of velocities attributed to drill pipe rotational speed in the wellbore and annular flow of drilling fluid in the wellbore involves:

$$\eta = \frac{\omega_L R_{i,L}}{U_L} = \frac{\omega_F R_{i,F}}{U_F};$$

U is axial velocity of the fluid during annular flow, which can be calculated as:

$$U = \frac{Q}{\pi(R_o^2 - R_i^2)};$$

Q is volumetric pumping rate of the fluid and particles mixture; $R_o$ and $R_i$ are radii of the inner eccentric pipe and the outer pipe, respectively; w is angular velocity of the inner eccentric pipe; and L and F denote corresponding parameters of fluid flow within the flow loop system and annular flow of the wellbore, respectively.

In some embodiments, imposing dynamic similarities involves requiring the Reynolds number, Taylor number, Froude number, and Buoyancy number of flow within the flow loop system to be equal to the corresponding dimensionless values of the annular flow of the wellbore.

In some embodiments, requiring the Reynolds number and, Taylor number, Froude number, and Buoyancy number of the fluid flow within the flow loop system to be equal to the corresponding dimensionless numbers of the wellbore involves:

$$\left(\frac{\rho U D_H}{\mu}\right)_L = \left(\frac{\rho U D_H}{\mu}\right)_F$$

and $$\left(\frac{\rho \omega R_i D_H}{\mu}\right)_L = \left(\frac{\rho \omega R_i D_H}{\mu}\right)_F;$$

$$\left(\frac{\rho_f V_{sl} D_s}{\mu_{fl}}\right)_L = \left(\frac{\rho_f V_{sl} D_s}{\mu_{fl}}\right)_F$$

and $$\left(\frac{\rho_s}{\rho_f}\right)_L = \left(\frac{\rho_s}{\rho_f}\right)_F$$

$\rho_s$ is the density of solids; $\rho_f$ the density of fluid; $D_s$ is the solid particle or cutting size; $\mu_{fl}$ is the viscosity of fluid; $V_{sl}$ is the slip velocity of the particles or drill cuttings; $\mu$ is the effective viscosity of the mixture; $u_{fl}$ is the effective viscosity of the fluid; $\omega$ is angular velocity of the inner eccentric pipe; U is axial velocity of the fluid during annular flow, which can be calculated as:

$$U = \frac{Q}{\pi(R_o^2 - R_i^2)};$$

Q is volumetric fluid pumping rate; $R_o$ and $R_i$ are radii of the inner eccentric pipe and the outer pipe, respectively; $D_H$ denotes effective hydraulic diameter for fluid flow, wherein $D_H=\alpha(R_o-R_i)$ with $\alpha$ being a dimensionless value between 1 and 2; and L and F denote corresponding parameters of fluid flow within the flow loop system and annular flow of the wellbore, respectively.

An exemplary embodiment relates to a method for estimating wellbore circulation density via a flow loop system comprising: an eccentric annulus structure having an inner eccentric and rotating pipe, and an outer pipe, the inner eccentric pipe representative of a drill string in a wellbore, the outer pipe representative of the wellbore; a pressure sensor configured to measure pressure loss gradients of annular flows between the inner eccentric pipe and the outer pipe; and a wellbore circulation density processing module configured to estimate the wellbore's bottomhole pressure based on the measured loss gradients of annular flows, rotation of the inner eccentric pipe, and eccentricity of the inner eccentric pipe. The method involves measuring pressure loss gradients of annular flows between the inner eccentric pipe and the outer pipe. The method involves estimating the wellbore's bottomhole pressure based on the measured loss gradients of annular flows, flow rates, rotation of the inner eccentric pipe, and eccentricity of the inner eccentric pipe.

In some embodiments, the method involves using appropriately scaled fluid flow rate within the flow loop system and inner eccentric pipe rotation speed to mimic annular flow of drilling fluid in the wellbore and drill pipe rotational speed in the wellbore.

In some embodiments, the method involves imposing geometric, kinematic, dynamic, and rheological similarities between fluid flow within the flow loop system and annular flow of the wellbore such that Fanning friction factors in the flow loop system are identical to Fanning friction factors in the wellbore.

In some embodiments, imposing geometric, kinematic, dynamic, and rheological similarities is done simultaneously.

In some embodiments, the eccentric annulus structure comprises: the inner eccentric pipe configured as a rotor; the outer pipe configured as a stator; a pump configured to circulate fluid through the eccentric annulus structure; a variable speed motor in mechanical connection with the inner eccentric pipe; and a feeder configured to inject particulate material into the circulating fluid. The method involves: circulating fluid through the eccentric annulus structure; and injecting particulate material into the circulating fluid.

In some embodiments, the particulate material is selected to mimic drill cutting material.

In some embodiments imposing geometric similarities involves requiring length ratios between mixture flow within the flow loop system and annular flow of the wellbore to be identical. Imposing kinematic similarities involves requiring a ratio of velocities attributed to the inner eccentric pipe rotation and the pump flow rate to equate to a ratio of velocities attributed to drill pipe rotational speed in the wellbore and annular flow of drilling fluid in the wellbore. Imposing dynamic similarities involves requiring the Reynolds number and the Taylor number of the fluid flow within the flow loop system to be equal to the Reynolds number and the Taylor number of the annular flow of the wellbore.

Further features, aspects, objects, advantages, and possible applications of the present invention will become apparent from a study of the exemplary embodiments and examples described below, in combination with the Figures, and the appended claims.

BRIEF DESCRIPTION OF THE FIGURES

The above and other objects, aspects, features, advantages, and possible applications of the present invention will be more apparent from the following more particular description thereof, presented in conjunction with the following drawings. It should be understood that like reference numbers used in the drawings may identify like components.

DETAILED DESCRIPTION OF THE INVENTION

The following description is of an embodiment presently contemplated for carrying out the present invention. This description is not to be taken in a limiting sense but is made merely for the purpose of describing the general principles and features of the present invention. The scope of the present invention should be determined with reference to the claims.

Figure 1:
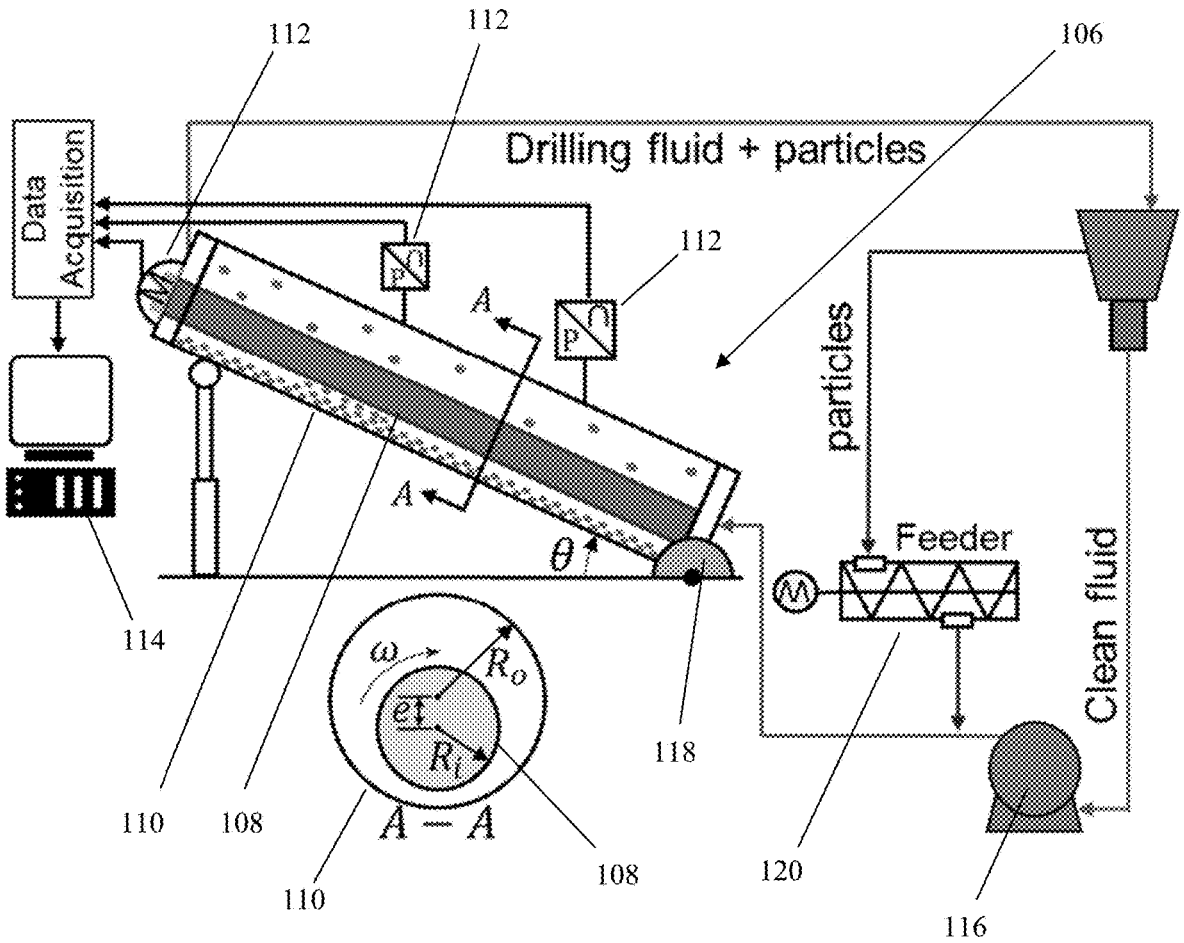
FIG. 1 shows an exemplary schematic of a flow loop system for estimating wellbore circulation density.
Figure 2:
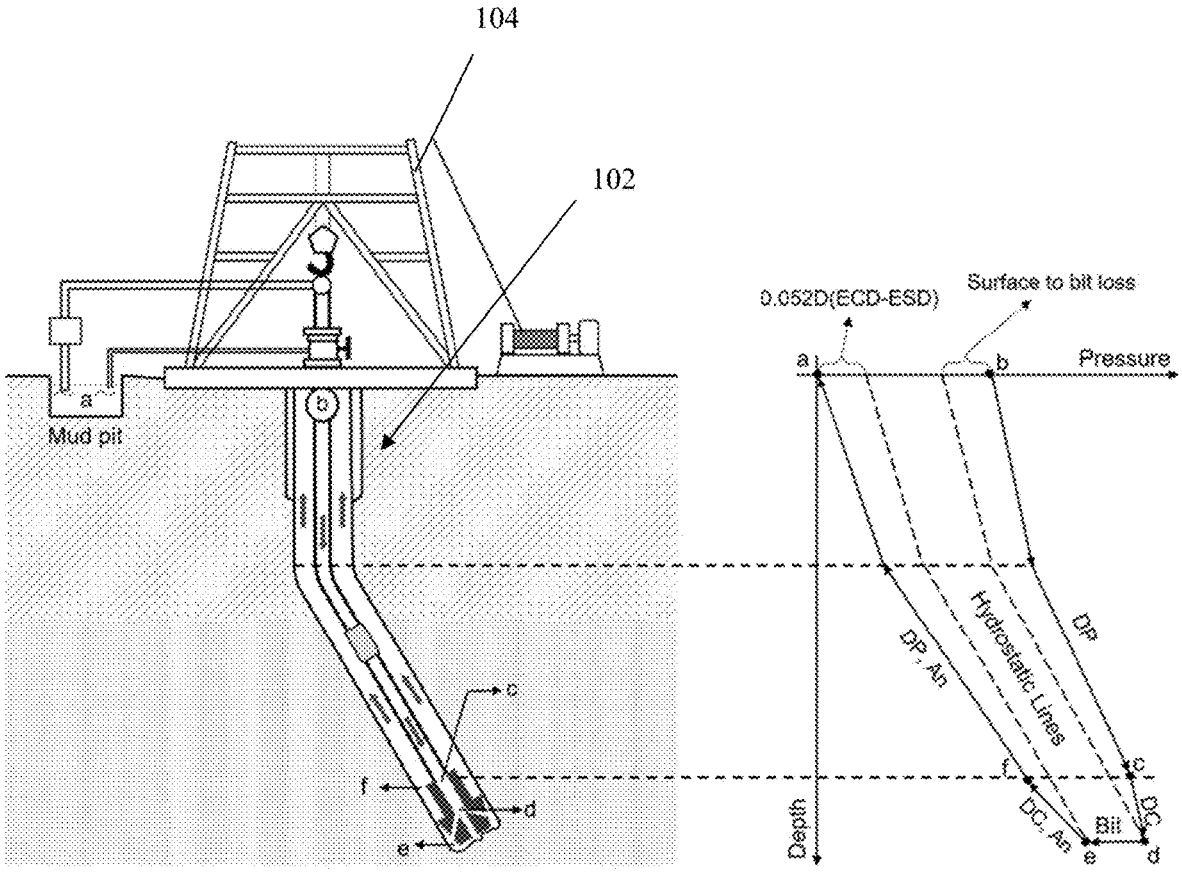
FIG. 2 shows a subterranean wellbore and pressure or circulation density distribution along the wellbore.
Figure 3:
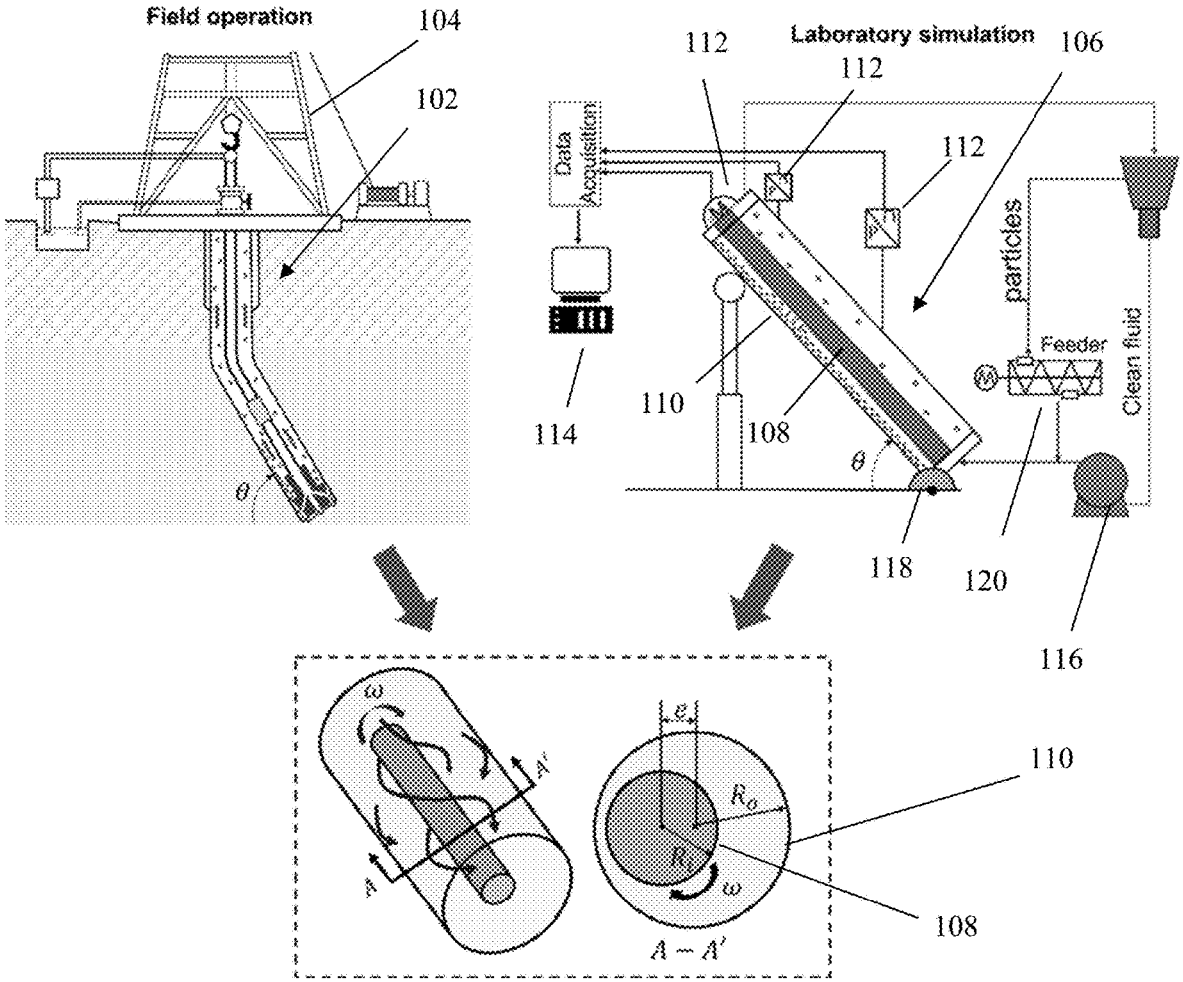
FIG. 3 shows a schematic of an exemplary similitude between a field operation and a lab simulation.

Referring to FIGS. 1-3, embodiments relate to a flow loop system 100 for estimating wellbore circulation density. The flow loop system 100 can be a benchtop device used off-site from the rig 104 to estimate the wellbore circulation density of the wellbore 102 at the rig 104—e.g., the flow loop system 100 can be used in a laboratory to estimate wellbore circulation density of a wellbore in the field. The flow loop system 100 includes an eccentric annulus structure 106. The eccentric annulus structure 106 has an inner eccentric pipe 108 and an outer pipe 110. The inner eccentric pipe 108 is representative of a drill string in the wellbore 102. The outer pipe 110 is representative of the wellbore 102.

The flow loop system 100 includes a pressure sensor 112 configured to measure pressure loss gradients of annular flows between the inner eccentric pipe 108 and the outer pipe 110. It should be understood that there can be any number of pressure sensors 112 to measure pressure gradients.

The flow loop system 100 includes a wellbore circulation density processing module 114 configured to estimate the wellbore's bottomhole pressure based on the measured loss gradients of annular flows, rotation of the inner eccentric pipe 108, and eccentricity of the inner eccentric pipe 108. The wellbore circulation density processing module 114 can be a processor with an associated memory configured to store and execute an algorithm based on the methods and techniques disclosed herein. The processor can be a hardware module or a software module. The memory can be a computer readable medium and can include non-volatile, non-transitory memory. The algorithm can cause the wellbore circulation density processing module 114 to use fluid flow rate within the flow loop system 100 and inner eccentric pipe 108 rotation speed to mimic annular flow of drilling fluid in the wellbore 102 and drill pipe rotational speed in the wellbore 102. As will be explained herein, this can be achieved by imposing geometric, kinematic, dynamic, and rheological similarities between fluid flow within the flow loop system 100 and annular flow of the wellbore 102 such that Fanning friction factors in the flow loop system 100 are identical to Fanning friction factors in the wellbore 102. In some embodiments, the wellbore circulation density processing module 114 is configured to impose geometric, kinematic, and dynamic similarities simultaneously.

As noted above, the system 100 can include a processor or a processing module. This disclosure may reference one or more processors on one or more processing modules. Any of the processing modules discussed herein can include a processor and associated memory. A processing module can be embodied as software and stored in memory, the memory being operatively associated with the processor. A processing module can be a software or firmware operating module configured to implement any of the method steps or algorithms disclosed herein. A processing module can be embodied as a web application, a desktop application, a console application, etc. Any of the processors discussed herein can be hardware (e.g., processor, integrated circuit, central processing unit, microprocessor, core processor, computer device, etc.), firmware, software, etc. configured to perform operations by execution of instructions embodied in algorithms, data processing program logic, artificial intelligence programming, automated reasoning programming, etc. It should be noted that use of processors herein can include Graphics Processing Units (GPUs), Field Programmable Gate Arrays (FPGAs), Central Processing Units (CPUs), etc. Any of the memory discussed herein can be computer readable memory configured to store data. The memory can include a volatile or non-volatile, transitory or non-transitory memory (e.g., as a Random Access Memory (RAM)), and be embodied as an in-memory, an active memory, a cloud memory, etc. Embodiments of the memory can include a processor module and other circuitry to allow for the transfer of data to and from the memory, which can include to and from other components of a communication system. This transfer can be via hardwire or wireless transmission. The communication system can include transceivers, which can be used in combination with switches, receivers, transmitters, routers, gateways, wave-guides, etc. to facilitate communications via a communication approach or protocol for controlled and coordinated signal transmission and processing to any other component or combination of components of the communication system. The transmission can be via a communication link. The communication link can be electronic-based, optical-based, opto-electronic-based, quantum-based, etc.

A more detailed discussion of the flow loop system 100 follows. The flow loop system 100 includes an eccentric annulus structure 106. The eccentric annulus structure 106 has an inner eccentric pipe 108 configured as a rotor and an outer pipe 110 configured as a stator. A pump 116 is used to circulate fluid through the eccentric annulus structure 106. A variable speed motor 118 can be placed in mechanical connection with the inner eccentric pipe 108 to cause the inner eccentric pipe 108 to rotate. A feeder 120 can be used to inject particulate material into the circulating fluid. The particulate material can be selected to mimic the drill cutting material geometric and dynamic similarity with drill cutting material.

The algorithm can be programmed to impose geometric similarities by requiring length ratios between fluid flow within the flow loop system 100 and annular flow of the wellbore 102 to be identical. For instance, $$\frac{R_{i,L}}{D_{H,L}} = \frac{R_{i,F}}{D_{H,F}}$$

-continued and $$\frac{e_L}{D_{H,L}} = \frac{e_F}{D_{H,F}},$$

wherein:

$R_o$ and $R_i$ are radii of the inner eccentric pipe and the outer pipe, respectively;

e is drill pipe eccentricity;

$D_H$ denotes effective hydraulic diameter for fluid flow, wherein $D_H=\alpha(R_o-R_i)$ with $\alpha$ being a dimensionless value between 1 and 2; and L and F denote corresponding parameters of fluid flow within the flow loop system and annular flow of the wellbore, respectively.

The algorithm can be programmed to impose kinematic similarities by requiring a ratio of velocities attributed to the inner eccentric pipe 108 rotation and the pump flow rate to equate to a ratio of velocities attributed to drill pipe rotational speed in the wellbore 102 and annular flow of drilling fluid in the wellbore 102. For instance, $$\eta = \frac{\omega_L R_{i,L}}{U_L} = \frac{\omega_F R_{i,F}}{U_F},$$

wherein:

U is axial velocity of the fluid during annular flow, which can be calculated as:

$$U = \frac{Q}{\pi(R_o^2 - R_i^2)};$$

Q is volumetric mixture pumping rate;

$R_o$ and $R_i$ are radii of the inner eccentric pipe and the outer pipe, respectively;

$\omega$ is angular velocity of the inner eccentric pipe; and

L and F denote corresponding parameters of fluid flow within the flow loop system and annular flow of the wellbore, respectively.

The algorithm can be programmed to impose dynamic similarities by requiring the Reynolds number, Taylor number, Froude number, and Buoyancy number of the mixture flow within the flow loop system 100 to be equal to the corresponding dimensionless numbers of the annular flow of the wellbore 102. For instance, $$\left(\frac{\rho U D_H}{\mu}\right)_L = \left(\frac{\rho U D_H}{\mu}\right)_F$$

and $$\left(\frac{\rho \omega R_i D_H}{\mu}\right)_L = \left(\frac{\rho \omega R_i D_H}{\mu}\right)_F,$$

wherein:

$\rho$ is fluid density;

$\mu$ is viscosity of the Newtonian fluid;

$\omega$ is angular velocity of the inner eccentric pipe;

U is axial velocity of the fluid during annular flow, which can be calculated as:

$$U = \frac{Q}{\pi(R_o^2 - R_i^2)};$$

Q is volumetric fluid pumping rate;

$R_o$ and $R_i$ are radii of the inner eccentric pipe and the outer pipe, respectively;

$D_H$ denotes effective hydraulic diameter for fluid flow, wherein $D_H=\alpha(R_o-R_i)$ with $\alpha$ being a dimensionless value between 1 and 2; and L and F denote corresponding parameters of fluid flow within the flow loop system and annular flow of the wellbore, respectively.

Some embodiments relate to a method for estimating wellbore circulation density via a flow loop system 100. The flow loop system 100 includes an eccentric annulus structure 106 having an inner eccentric pipe 108 and an outer pipe 110. The inner eccentric pipe 108 is representative of a drill string in a wellbore 102. The outer pipe 110 is representative of the wellbore 102. The flow loop system 100 includes a pressure sensor 112 configured to measure pressure loss gradients of annular flows between the inner eccentric pipe 108 and the outer pipe 110. The flow loop system 100 includes a wellbore circulation density processing module 114 configured to estimate the wellbore's bottomhole pressure based on the measured loss gradients of annular flows, rotation of the inner eccentric pipe 108, and eccentricity of the inner eccentric pipe 108. With this flow loop system 100, the method involves measuring pressure loss gradients of annular flows between the inner eccentric pipe 108 and the outer pipe 110. The method further involves estimating the wellbore's bottomhole pressure based on the measured loss gradients of annular flows, rotation of the inner eccentric pipe 108, flow rate of fluid and solid particles, and eccentricity of the inner eccentric pipe 108.

In some embodiment, the method involves using mixture flow rate within the flow loop system 100 and inner eccentric pipe 108 rotation speed to mimic annular flow of drilling fluid and drill cuttings in the wellbore 102 and drill pipe rotational speed in the wellbore 102.

In some embodiment, the method involves imposing geometric, kinematic, dynamic, and rheological similarities between fluid flow within the flow loop system 100 and annular flow of the wellbore 102 such that Fanning friction factors in the flow loop system 100 are identical to Fanning friction factors in the wellbore 102. In some embodiment, imposing geometric, kinematic, dynamic, and rheological similarities is done simultaneously.

In some embodiment, the eccentric annulus structure 106 includes the inner eccentric pipe 108 configured as a rotor and the outer pipe 110 configured as a stator. The eccentric annulus structure 106 has a pump 116 configured to circulate fluid through the eccentric annulus structure 106. The eccentric annulus structure 106 has a variable speed motor 118 in mechanical connection with the inner eccentric pipe 108. The eccentric annulus structure 106 has a feeder 120 configured to inject particulate material into the circulating fluid. With this eccentric annulus structure 106 set up, the method involves circulating fluid through the eccentric annulus structure 106 and injecting particulate material into the circulating fluid. The particulate material can be selected to mimic drill cutting material.

In some embodiments, the method involves imposing geometric similarities by requiring length ratios between fluid flow within the flow loop system 100 and annular flow of the wellbore 102 to be identical. The method further involves imposing kinematic similarities by requiring a ratio of velocities attributed to the inner eccentric pipe 108 rotation and the pump flow rate to equate to a ratio of velocities attributed to drill pipe rotational speed in the wellbore 102 and annular flow of drilling fluid and drill cuttings in the wellbore 102. The method further involves imposing dynamic similarities by requiring, e.g., the Reynolds number and the Taylor number of the fluid flow within the flow loop system 100 to be equal to the Reynolds number and the Taylor number of the annular flow of the wellbore 102.

The techniques disclosed herein offer a new direction compared to existing theoretical methods of wellbore hydraulics calculations by taking advantage of direct measurements from a benchtop wellbore similitude device, along with appropriate scaling schemes. The benchtop wellbore similitude device is shown in FIG. 1. Flow loop experiments for measuring pressure drop of annular flow been used to validate or calibrate the numerical and analytical solutions on the subject (32, 33). The transformational aspect of the design stems from the underlying simplicity in the laws of similarity and scaling in fluid mechanics. The main hypothesis is that through correct scaling of the key dimensionless groups of the flow parameters, an appropriate scaling between pressure loss gradients measured by the device and those occurring in the wellbore can be appropriately formulated. This approach enables a direct measurement technique for estimating the wellbore ECD while benefiting from an unprecedented reduction in the device size compared to existing flow loops that are being used to study wellbore hydraulics.

The described benchtop device has been fabricated and tested, and results have been compared against circulation density (or bottomhole pressure) data of wells. By obtaining satisfactory agreement with field data, the device can be set for engineering fabrication and used at highly competitive performance compared to existing methods of estimating the wellbore circulation density.

Benefits of the techniques disclosed herein are reduced nonproductive time of drilling, increased rate of penetration, and substantial reduction in total cost of the well. The resulting enhancement in the accuracy of ECD estimates may facilitate narrow-margin and extended-reach drilling to access more energy resources of renewable (e.g., geothermal) or nonrenewable (oil and gas) types.

The wellbore ECD estimates using conventional numerical or analytical models, particularly when the cutting load of the flow (defined as the volume ratio of cuttings in the annular flow) is relatively high, involves error rates that may exceed the entire drilling margin of the well section. Under such circumstances, designing a wellbore hydraulics program using conventional drilling methods is not be feasible (34). The techniques disclosed herein offer a direct method of measuring the ECD from appropriately scaled parameters of the wellbore hydraulics. Therefore, the theoretical rate of error is within the error margin of the device pressure sensors.

FIG. 1 shows that a two-phase flow of drilling fluid and cuttings occurs through an eccentric annulus. The inner pipe is powered by the motor at the end of the annular flow section. The discharge fluid is filtered and pumped back to the annulus while appropriately sized particles mimicking the drill cuttings are reinjected into the flow through a feeder. The scaling formulations for the device follow the geometric, kinematic, rheologic, and dynamic similarities of the field-scale and laboratory-scale flows. These similarities are identified through dimensionless variables discussed herein.

The geometric similarity of the drilling hydraulics similitude device requires the ratios $\psi=R_{i,L}/R_{i,F}=R_{o,L}/R_{o,F}=e_L/e_F$ in between the field and lab lengths to be identical. Likewise, the kinematic similarity demands for the ratio of angular to axial velocities of the flow $\eta=\omega_L R_{i,L}/U_L=\omega_F R_{i,F}/U_F$ to be the same between the lab and field. Lastly, the dynamic similarity requires equal Reynolds and Taylor (35) numbers among other dimensionless numbers in between the two flows. These conditions fulfill the requirements for attaining complete similarity between the single-phase annular flows in the laboratory and field for Newtonian fluids. Under such conditions, the dimensionless friction factor f of the two flow scales can be identical, as well, i.e., $f_L=f_F$ where $f=(D_H/4\rho U)(\Delta p/\Delta x)$ in which $D_H \propto (R_o-R_i)$. $\mu$ and $\rho$ are the fluid viscosity and density.

It can be shown that for complex fluid rheologies such as yield-power law, the complete similarity between the wellbore and laboratory flow loop cannot be attained when the two fluids are the same. In such cases the Rheological similarity, for instance through the equality of Hedstrom numbers between the flow loop device and wellbore $$\left(\frac{\rho D_H^2 \tau_0}{\mu^2}\right)_L = \left(\frac{\rho D_H^2 \tau_0}{\mu^2}\right)_F$$

$\rho$ is mixture density; u is mixture viscosity; Q is volumetric fluid pumping rate; $\tau_0$ is the yield stress, $D_H$ denotes effective hydraulic diameter for fluid flow, wherein D_H=$\alpha$ (R_o–R_i) with a being a dimensionless value between 1 and 2; $R_o$ and $R_i$ are radii of the inner eccentric pipe and the outer pipe, respectively; and L and F denote corresponding parameters of fluid flow within the flow loop system and annular flow of the wellbore, respectively.

A well-designed simulation of the drilling fluid flow along the wellbore annulus requires the laboratory setup to achieve a full similitude with the field condition, so that the test results from the lab scale can be directly applicable to the field operation. As shown in FIG. 3, the techniques disclosed herein are based on a setup comprising an inner pipe simulating the drill string, as well as an outer pipe simulating the wellbore. The objective is to precisely measure the same friction factor along the flow loop pipes as what is expected to occur along the wellbore annulus. This objective can be met by establishing geometric, kinematic, and dynamic similarities between the lab and field-scale flows. By taking advantage of dimensional analysis and laws of similarity, the dimensions of the pipes, pump flow rate, and inner pipe rotation speed in the flow loop experiment can be obtained as a function of the corresponding wellbore and drill string dimensions, as well as the pump rate and drill pipe rotation speed at the rig site.

In FIG. 3, $R_o$ and $R_i$ are the radii of the inner and outer pipe, respectively. e is the drill pipe eccentricity; $\omega$ is the angular velocity of the inner pipe. Q is the volumetric fluid pumping rate.

Newtonian fluids assume a constant viscosity. Fully developed flow of Newtonian fluid in an eccentric annulus with rotating inner pipe involves a total of eight variables and three dimensions, as shown in Table 1.

$\Delta p/\Delta x$ is the pressure gradient along the drill pipe;

$\rho$ is the fluid density; u is the viscosity of the Newtonian fluid;

U is the axial velocity of the fluid;

ω is the angular velocity of the inner pipe; Re is the Reynolds number;

Ta denotes the Taylor number;

f is the friction coefficient, which is related to the Euler's number by $$f = \frac{D_H}{8\Delta x}$$

Eu during fully developed flow, and the Euler's number defined as $Eu=2\Delta p/(\rho U^2)$ is usually used to scale the magnitude of pressure drop;

$D_H$ denotes the effective hydraulic diameter for fluid flow, which is defined as (1):

$$D_H = \alpha(R_o - R_i) \tag{1}$$

with α being a dimensionless value between 1 and 2.

TABLE 1

The involved variables, dimensions, and dimensionless parameters for Newtonian fluid case

| Group | Quantity | Expression |
|---|---|---|
| Involved variables | 8 | $\frac{\Delta p}{\Delta x}, \rho, \mu, R_o, R_i, e, \omega, U$ |
| Involved dimensions | 3 | L, T, M |
| Dimensionless variables | 5 | $\frac{R_i}{D_H}, \frac{e}{D_H}, Re = \frac{\rho U D_H}{\mu}, Ta = \frac{\rho\omega R_i D_H}{\mu}, f = \frac{D_H}{4\rho U^2}\frac{\Delta p}{\Delta x}$ |

A complete similitude requires that the lab-scale and field-scale flows share identical dimensionless numbers. The following similarities must be attained for this purpose:

Geometric Similarity

The geometric similarity requires the length ratios between lab and field flows to be identical, i.e., $$\frac{R_{i,L}}{D_{H,L}} = \frac{R_{i,F}}{D_{H,F}} \tag{2}$$

$$\frac{e_L}{D_{H,L}} = \frac{e_F}{D_{H,F}} \tag{3}$$

where, subscripts L and F denote the corresponding parameters of the lab and field flows, respectively;

the parameter ψ is introduced to represent these ratios, as follows.

$$\psi = \frac{R_{i,L}}{R_{i,F}} = \frac{R_{o,L}}{R_{o,F}} = \frac{D_{H,L}}{D_{H,F}} = \frac{e_L}{e_F} \tag{4}$$

Kinematic Similarity

Kinematics of fluid flow in the described system is determined by the two characteristic velocities attributed to the inner pipe rotation and pump flow rate. The kinematic similarity ensures that the two systems have the same ratio of these characteristic velocities in the lab and field.

$$\eta = \frac{\omega_L R_{i,L}}{U_L} = \frac{\omega_F R_{i,F}}{U_F} \tag{5}$$

ω is the angular velocity of the inner pipe;

U is the axial velocity of the fluid during annular flow, which can be calculated as:

$$U = \frac{Q}{\pi(R_o^2 - R_i^2)} \tag{6}$$

Dynamic Similarity

The annular fluid Reynolds number, $$Re = \frac{\rho U D_H}{\mu}$$

and Taylor number, $$Ta = \frac{\rho\omega R_i D_H}{\mu}$$

determine the regime. These numbers must be equal in the lab and wellbore flows. That is, $$\left(\frac{\rho U D_H}{\mu}\right)_L = \left(\frac{\rho U D_H}{\mu}\right)_F \tag{7}$$

$$\left(\frac{\rho\omega R_i D_H}{\mu}\right)_L = \left(\frac{\rho\omega R_i D_H}{\mu}\right)_F \tag{8}$$

In the context of fluid mechanics, the Reynolds number is usually used to characterize the relative contrast between viscous force to the inertial force during fluid flow. The value of Reynolds number determines the flow regime, i.e., larminar flow, turbulent flow, and transition flow. The Taylor number is basically the rotational analogue of Reynolds number as it is defined as the viscous force caused by rotational movement to the inertial force.

The requirement for $Q_L$ of Newtonian fluids yields, after substitution from Eq. (6) in Eq. (7):

$$Q_L = Q_F\psi\left(\frac{\rho_F\mu_L}{\mu_F\rho_L}\right) \tag{9}$$

Likewise, the $\omega_L$ expression can be obtained through the simplification of either Eq. (5) or (8).

$$\omega_L = \omega_F \psi^{-2} \left(\frac{\rho_F \mu_L}{\mu_F \rho_L}\right) \tag{10}$$

A complete similitude requires simultaneous geometric, kinematic, and dynamic similarities between the model and prototype. Under such conditions and according to the Buckingham Π theorem, the remaining dimensionless group of the problem, i.e., Euler's number, or alternatively, the friction factors of the two flows become identical. That is, simultaneous imposition of Eqs. (2), (3), (5), (7), and (8) complete the considered similitude between the flow loop and wellbore flows, yielding identical Euler numbers, and therefore, friction factors between the two annular flows. Consequently, the following relation between the corresponding pressure gradients is obtained.

$$\frac{D_{H,L}}{4\rho_L U_L^2}\left(\frac{\Delta p}{\Delta x}\right)_L = \frac{D_{H,F}}{4\rho_F U_F^2}\left(\frac{\Delta p}{\Delta x}\right)_F \tag{11}$$

Substitution for U from Eq. (6) in Eq. (11) and rearranging the mathematical terms gives, $$\left(\frac{\Delta p}{\Delta x}\right)_F = \psi\left(\frac{\rho_F}{\rho_L}\right)\frac{U_F^2}{U_L^2}\left(\frac{\Delta p}{\Delta x}\right)_L = \psi^3\left(\frac{\rho_L}{\rho_F}\right)\left(\frac{\mu_L}{\mu_F}\right)^{-2}\left(\frac{\Delta p}{\Delta x}\right)_L \tag{12}$$

Eqs. (9), (11), and (12) determine $Q_L$, $\omega_L$ required for the laboratory measurement, as well as the prediction of $$\left(\frac{\Delta p}{\Delta x}\right)_F$$

describing the pressure loss of wellbore annular flow.

The rheology of power-law fluids is described by the consistency index K and power index n, as follows:

$$\tau = K\dot{\gamma}^n \tag{13}$$

where, $\tau$ is the shear stress;

$\dot{\gamma}$ is the flow shear rate.

Consequently, the apparent viscosity of fluid flow can then be obtained from the apparent viscosity of the power-law fluid, as follows (9,36):

$$\mu_{pl} = \frac{\tau}{\dot{\gamma}} \tag{14}$$

The characteristic velocity of the annular flow is obtained by the vector sum of the mean axial velocity and tangential velocity at the inner pipe boundary, as follows.

$$u_c = \sqrt{U^2 + \omega^2 R^2} \tag{15}$$

where, $u_c$ is the characteristic flow rate.

The characteristic shear rate j, can be obtained by dividing the characteristic velocity from Eq. (15) to the characteristic length $D_H$ of the annular flow. That is, $$\dot{\gamma} = \sqrt{\left(\frac{U}{D_H}\right)^2 + \left(\frac{\omega R}{D_H}\right)^2} \tag{16}$$

Substitution of Eqs. (13) and (16) into Eq. (14) determines the apparent viscosity of the flow, as follows, $$\mu_{pl} = K\dot{\gamma}^{n-1} = K\left(\frac{U}{D_H}\sqrt{1+\eta^2}\right)^{n-1} \tag{17}$$

where, $$\eta = \frac{\omega R_i}{U} \tag{18}$$

The involved variables, dimensions, and dimensionless groups of power-law fluid flow in the annulus are summarized in Table 2. The power-law fluids involve the power index $n=n_L=N_F$ as the additional dimensionless parameter compared to the Newtonian fluid. Consequently, an additional type of similitude, rheological similarity, is needed to achieve a complete similitude. However, the consistency index of the two fluids may be different.

TABLE 2

The involved variables, dimensions, and dimensionless parameters for power-law fluid case

| Group | Quantity | Expression |
|---|---|---|
| Involved variables | 9 | $\frac{\Delta p}{\Delta x}$, $p$, $R_o$, $R_i$, $e$, $\omega$, $U$, $K$, $n$ |
| Involved dimensions | 3 | L,T, M |
| Dimensionless variables | 6 | $\frac{R_i}{D_H}$, $\frac{e}{D_H}$, $Re_{pl} = \frac{\rho U D_H}{\mu_{pl}}$, $Ta_{pl} = \frac{\rho \omega R_i D_H}{\mu_{pl}}$, $f = \frac{D_H}{4\rho U^2}\frac{\Delta p}{\Delta x}$, $n$ |

Substituting the Eq. (17) into the expression for Reynolds number from Table 2 gives:

$$\mathrm{Re}_{pl} = \frac{\rho U^{2-n} D_H^n (1+\eta^2)^{\frac{1-n}{2}}}{K} \tag{19}$$

Subsequently, the equality of Reynolds numbers, i.e., $\mathrm{Re}_L=\mathrm{Re}_F$, yields, $$\frac{\rho_L U_L^{2-n_L} D_{H,L}^{n_L}(1+\eta_L^2)^{\frac{1-n_L}{2}}}{K_L} = \frac{\rho_F U_F^{2-n_F} D_{H,F}^{n_F}(1+\eta_F^2)^{\frac{1-n_F}{2}}}{K_F} \tag{20}$$

From Eq. (5), the kinematic similarity requires that $\eta=\eta_L=\eta_F$. Thus, Eq. (20) reduces to:

$$\frac{\rho_L U_L^{2-n} D_{H,L}^n}{K_L} = \frac{\rho_F U_F^{2-n} D_{H,F}^n}{K_F} \tag{21}$$

Substituting U from Eq. (6) into Eq. (21) and simplifying the resulting terms gives:

$$Q_L = Q_F \psi^{\frac{4-3n}{2-n}} \left(\frac{\rho_F K_L}{K_F \rho_L}\right)^{\frac{1}{2-n}} \tag{22}$$

The expression of $\omega_L$ can be readily obtained by honoring $n_L = n_F$:

$$\frac{\omega_L R_{i,L}}{U_L} = \frac{\omega_F R_{i,F}}{U_F} \tag{23}$$

Therefore, $$\omega_L = \frac{R_{i,F} U_L}{R_{i,L} U_F} \omega_F \tag{24}$$

Substituting for U from Eq. (6) into Eq. (24) gives, $$\omega_L = \omega_F \psi^{-\left(\frac{2}{2-n}\right)} \left(\frac{\rho_{field} K_{lab}}{K_{field} \rho_{lab}}\right)^{\frac{1}{2-n}} \tag{25}$$

Finally, to achieve equal friction number:

$$\frac{D_{H,L}}{4\rho_L U_L^2}\left(\frac{\Delta p}{\Delta x}\right)_L = \frac{D_{H,F}}{4\rho_F U_F^2}\left(\frac{\Delta p}{\Delta x}\right)_F \tag{26}$$

which gives:

$$\left(\frac{\Delta p}{\Delta x}\right)_F = \psi^5 \left(\frac{\rho_L}{\rho_F}\right)^{-1} \frac{Q_F^2}{Q_L^2} \left(\frac{\Delta p}{\Delta x}\right)_L = \psi^{\frac{n+2}{2-n}} \left(\frac{K_L}{K_F}\right)^{\frac{2}{n-2}} \left(\frac{\rho_L}{\rho_F}\right)^{\frac{n}{2-n}} \left(\frac{\Delta p}{\Delta x}\right)_L \tag{27}$$

For the yield power-law fluids, or Herschel-Bulkley fluids, the shear stress is expressed as:

$$\tau = \tau_0 + K\dot{\gamma}^n \tag{28}$$

where $\tau_0$ denotes the yield stress.

Therefore, the apparent viscosity of yield power-law fields can be formulated as:

$$\mu_{ypl} = \tau_0 \dot{\gamma}^{-1} + K\dot{\gamma}^{n-1} \tag{29}$$

Table 3 shows the involved variables, dimensions, and dimensionless parameters for yield power-law fluid case.

TABLE 3

The involved variables, dimensions, and dimensionless parameters for yield power-law fluid case

| Group | Quantity | Expression |
|---|---|---|
| Involved variables | 10 | $\frac{\Delta p}{\Delta x}, \rho, R_o, R_i, e, \omega, U, K, n, \tau_o$ |
| Involved dimensions | 3 | L, T, M |
| Dimensionless variables | 7 | $\frac{R_i}{D_H}, \frac{e}{D_H}, Re = \frac{\rho U D_H}{\mu_{ypl}}, Ta = \frac{\rho \omega R_i D_H}{\mu_{ypl}}, f = \frac{D_H}{4\rho U^2}\frac{\Delta p}{\Delta x}, n, He = \frac{\rho D_H^2}{\mu_{ypl}}\left(\frac{\tau_0}{\mu_{ypl}}\right)$ |

Compared to the power-law fluids, the yield power-law fluids need an additional dimensionless parameter to scale the yield stress. The rheology-related Hedstrom number is adopted for this purpose (37,38). The Hedstrom number, defined as Eq. (30), is a dimensionless quantity used to identify the flow regimes for the fluids with a yield stress.

$$He = \frac{\rho D_H^2}{\mu_{ypl}}\left(\frac{\tau_0}{\mu_{ypl}}\right)$$

where, He is the Hedstrom number.

Consequently, the complete rheological similarity between the lab and field YPL fluids requires equality of the associated Hedstrom numbers, as well as the power index n.

Again, substituting Eq. (16) into the expression of apparent viscosity (Eq. (29)) yields:

$$\mu_{ypl} = \tau_0 \left(\frac{U}{D_H}\sqrt{1+\eta^2}\right)^{-1} + K\left(\frac{U}{D_H}\sqrt{1+\eta^2}\right)^{n-1} \tag{31}$$

Therefore, the Reynolds number is rewritten in terms of flow rate as, $$\mathrm{Re} = \frac{\dfrac{\rho Q^2}{\pi^2 (R_o^2 - R_i^2)^2}\sqrt{1+\eta^2}}{\tau_0 + K\left[\dfrac{Q\sqrt{1+\eta^2}}{\pi (R_o^2 - R_i^2) D_H}\right]^n} \tag{32}$$

Subsequently, the appropriate value of flow rate, angular velocity can be obtained by simultaneous application of below equations:

$$\mathrm{Re}_L = \mathrm{Re}_F \tag{33}$$

$$He_L = He_F \tag{34}$$

Hedstrom number from Eq. (30) can be expressed in terms of Reynolds number as:

$$He = \frac{\rho D_H^2}{\mu_{ypl}}\left(\frac{\tau_0}{\mu_{ypl}}\right) = \frac{\tau_0 \mathrm{Re}^2}{\rho U^2} \tag{35}$$

Therefore, the equality of Hedstrom number is equivalent to:

$$\frac{\tau_{o,L}\mathrm{Re}_L^2}{\rho_L U_L^2} = \frac{\tau_{0,F}\mathrm{Re}_F^2}{\rho_F U_F^2} \tag{36}$$

Substituting Eq. (6) for U in Eq. (36) while noting that $\mathrm{Re}_L=\mathrm{Re}_F$ yields, $$\tau_{0,L} = \frac{\rho_L Q_L^2}{\rho_F Q_F^2 \psi^4}\tau_{0,F} \tag{37}$$

Alternatively, $\mathrm{Re}_L=\mathrm{Re}_F$ demands the following equation to hold:

$$\frac{\dfrac{Q_L^2\rho_L}{\pi^2\left(R_{o,L}^2 - R_{i,L}^2\right)^2}\sqrt{1+\eta^2}}{\tau_{0,L} + K_L\left[\dfrac{\sqrt{1+\eta^2}}{\pi\left(R_{o,L}^2 - R_{i,L}^2\right)D_{H,L}}\right]^2 Q_L^n} = \frac{\dfrac{Q_F^2\rho_F}{\pi^2\left(R_{o,F}^2 - R_{i,F}^2\right)^2}\sqrt{1+\eta^2}}{\tau_{0,F} + K_F\left[\dfrac{\sqrt{1+\eta^2}}{\pi\left(R_{o,F}^2 - R_{i,F}^2\right)F_{H,F}}\right]^2 Q_F^n} \tag{38}$$

After substitution Eq. (37) into Eq. (38), $Q_L$ can be solved as the following formula in terms of $Q_F$.

$$Q_L = Q_F\psi^{\frac{4-3n}{2-n}}\left(\frac{K_L\rho_F}{K_F\rho_L}\right)^{\frac{1}{2-n}} \tag{39}$$

Meanwhile, the appropriate value of yield stress for lab conditions is also determined by substituting Eq. (39) into Eq. (37):

$$\tau_{0,L} = \psi^{-\frac{2n}{2-n}}\left(\frac{K_L}{K_F}\right)^{\frac{2}{2-n}}\left(\frac{\rho_L}{\rho_F}\right)^{\frac{n}{n-2}}\tau_{0,F} \tag{40}$$

Then, by securing the kinematic similarity condition, i.e., $n_L=n_F$ from Eq. (5) the expression for $\omega_L$ is obtained as, $$\omega_L = \frac{R_{i,F}U_L}{R_{i,L}U_F}\,\omega_F = \frac{Q_L}{\psi^3 Q_F}\omega_F \tag{41}$$

Substituting for $Q_L$ from Eq. (39) gives:

$$\omega_L = \psi^{-\left(\frac{2}{2-n}\right)}\left(\frac{K_L\rho_F}{K_F\rho_L}\right)^{\frac{1}{2-n}}\omega_F \tag{42}$$

Interestingly, the expression of $Q_L$ and $\omega_L$ for the yield power-law fluid is the same as the power-law case, but with an additional constraint for the yield stress, as obtained in Eq. (40), for the lab fluid.

Lastly, $$\left(\frac{\Delta p}{\Delta x}\right)_F$$

can be obtained through the equality of friction numbers, as follows:

$$\left(\frac{\Delta p}{\Delta x}\right)_F = \psi^3\left(\frac{\rho_L}{\rho_F}\right)^{-1}\frac{Q_F^2}{Q_L^2}\left(\frac{\Delta p}{\Delta x}\right)_L = \psi^{\frac{n+2}{2-n}}\left(\frac{K_L}{K_F}\right)^{\frac{2}{n-2}}\left(\frac{\rho_L}{\rho_F}\right)^{\frac{n}{2-n}}\left(\frac{\Delta p}{\Delta x}\right)_L \tag{43}$$

The lab parameters suggested for different fluid rheology models are summarized in Table 4.

TABLE 4

The summary of the lab parameters suggested for different fluid types

| Parameter | Newtonian | power-law | yield power-law |
|---|---|---|---|
| $Q_L$ | $Q_F\psi\left(\frac{\rho_F\mu_L}{\mu_F\rho_L}\right)$ | $Q_F\psi^{\frac{4-3n}{2-n}}\left(\frac{K_L\rho_F}{K_F\rho_L}\right)^{\frac{1}{2-n}}$ | $Q_F\psi^{\frac{4-3n}{2-n}}\left(\frac{K_L\rho_F}{K_F\rho_L}\right)^{\frac{1}{2-n}}$ |
| $\omega_L$ | $\omega_F\psi^{-2}\left(\frac{\rho_F\mu_L}{\mu_F\rho_L}\right)$ | $\psi^{-\left(\frac{2}{2-n}\right)}\left(\frac{K_L\rho_F}{K_F\rho_L}\right)^{\frac{1}{2-n}}\omega_F$ | $\psi^{-\left(\frac{2}{2-n}\right)}\left(\frac{K_L\rho_F}{K_F\rho_L}\right)^{\frac{1}{2-n}}\omega_F$ |
| $\tau_{o,L}$ | NA | NA | $\psi^{-\frac{2n}{2-n}}\left(\frac{K_L}{K_F}\right)^{\frac{2}{2-n}}\left(\frac{\rho_L}{\rho_F}\right)^{\frac{n}{n-2}}\tau_{0,F}$ |
| $\left(\frac{\Delta p}{\Delta x}\right)_F$ | $\psi^3\left(\frac{\rho_L}{\rho_F}\right)\left(\frac{\mu_L}{\mu_F}\right)^{-2}\left(\frac{\Delta p}{\Delta x}\right)_L$ | $\psi^{\frac{n+2}{2-n}}\left(\frac{K_L}{K_F}\right)^{\frac{2}{n-2}}\left(\frac{\rho_L}{\rho_F}\right)^{\frac{n}{2-n}}\left(\frac{\Delta p}{\Delta x}\right)_L$ | $\psi^{\frac{n+2}{2-n}}\left(\frac{K_L}{K_F}\right)^{\frac{2}{n-2}}\left(\frac{\rho_L}{\rho_F}\right)^{\frac{n}{2-n}}\left(\frac{\Delta p}{\Delta x}\right)_L$ |

The parameters appropriate for the lab experiment maybe very different from those used in a real drilling operation, accordingly, one need to assign specific value to the operational parameters of the lab ($Q_L$, $\omega_L$) to achieve a full similitude. This section focuses on analyzing how a contrast in operational parameters between lab and field conditions, such as $$Q_L/Q_F,\ \omega_L/\omega_F,\ \frac{\Delta p}{\Delta x_F}/\frac{\Delta p}{\Delta x_L}$$

ratios, depend on the contrast in the fluid/pipe parameters between the two conditions.

Figure 4A:
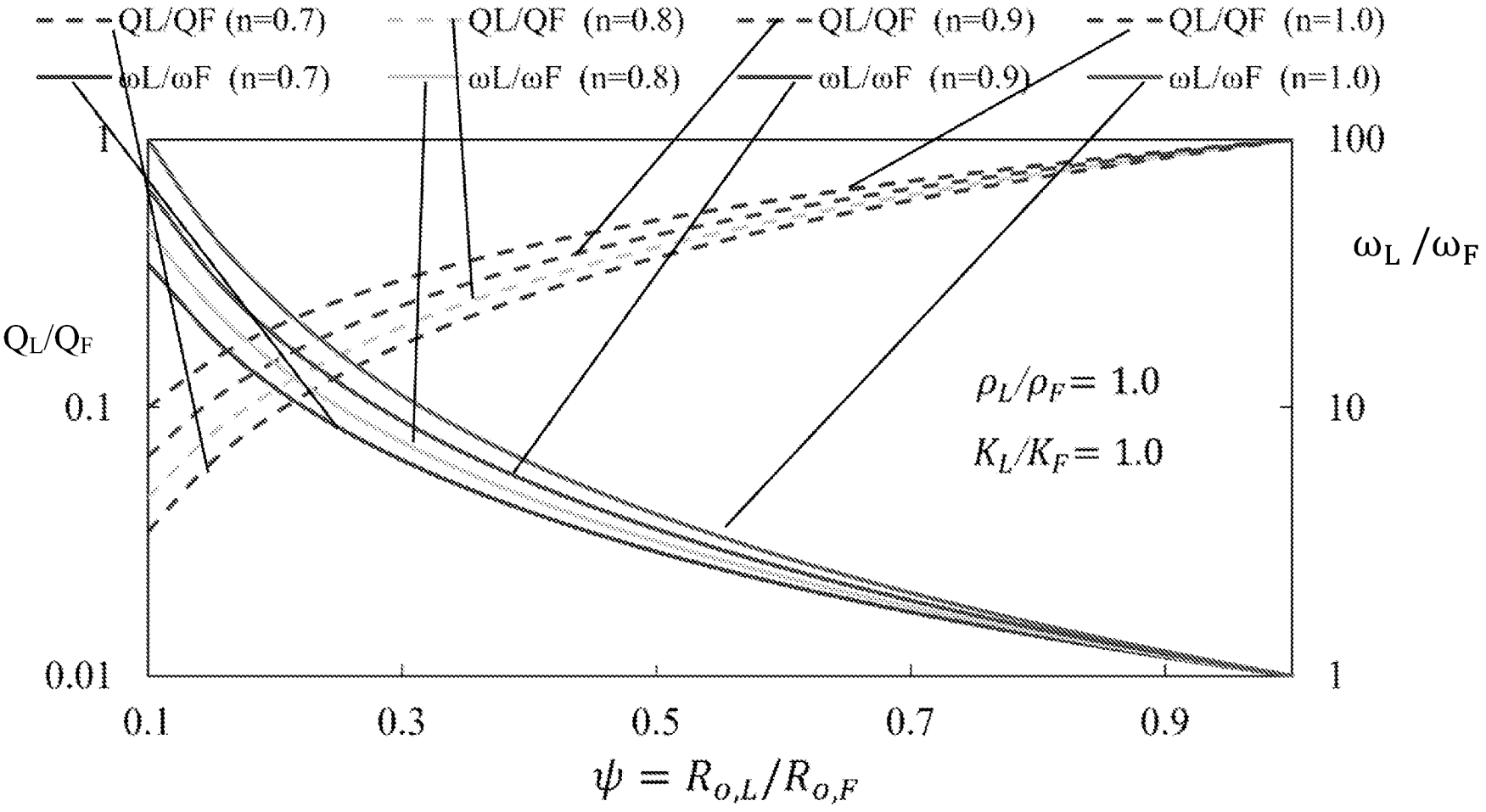
FIGS. 4A-4C show influence of the fluid rheological similarity on $Q_L/Q_F$ and $\omega_L/\omega_F$.
Figure 4B:
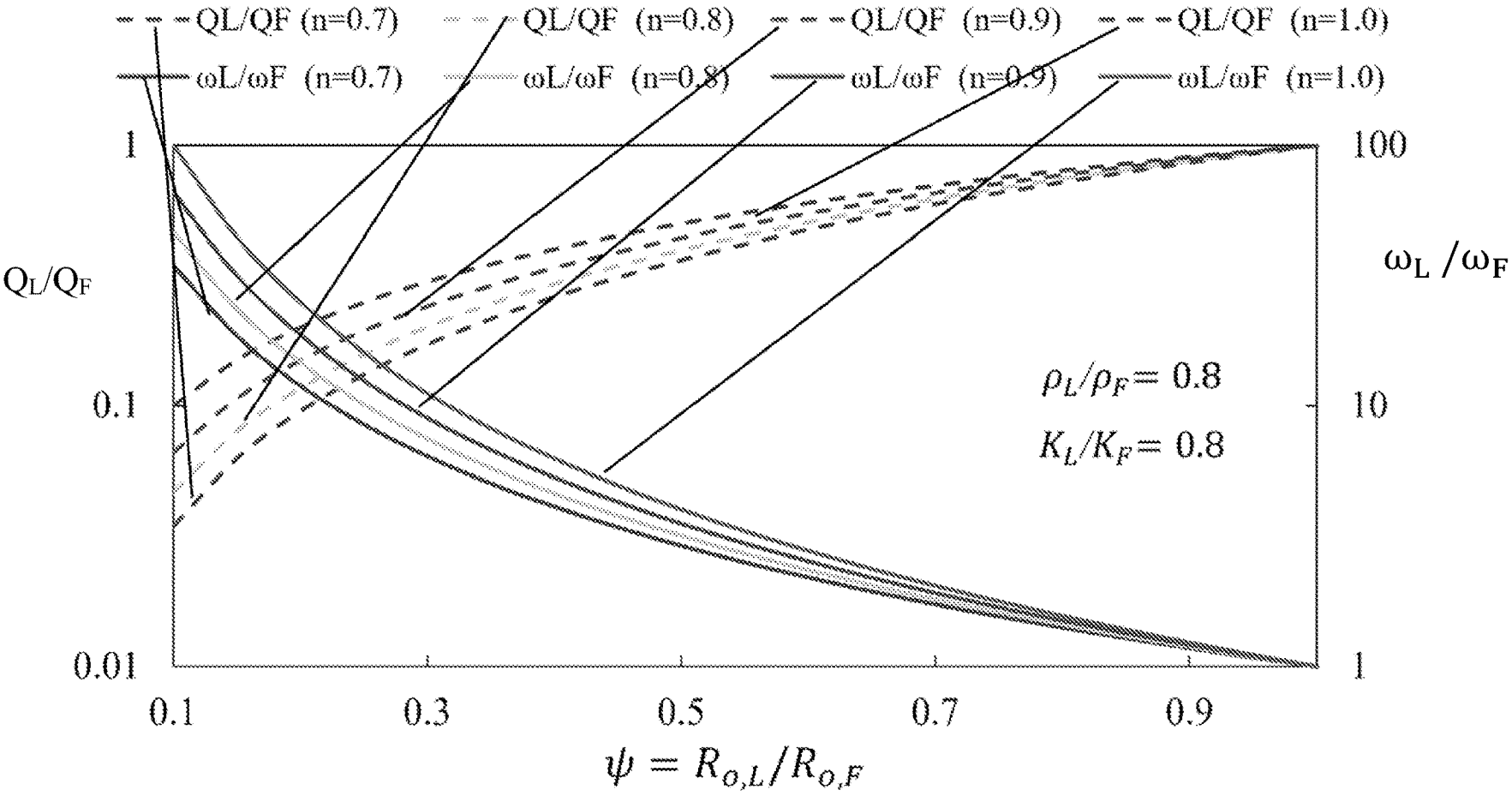
Figure 4C:
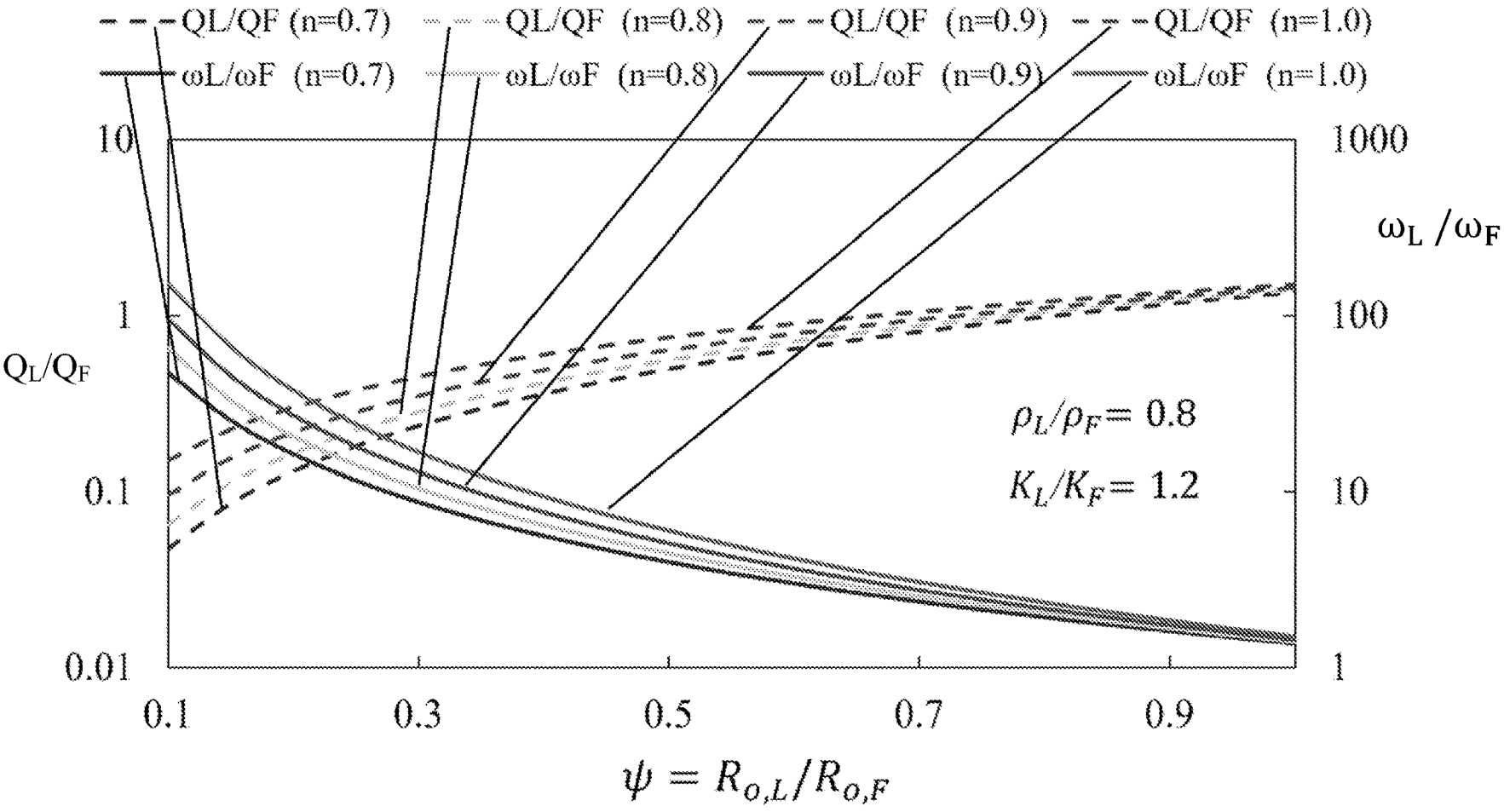

The dimensional analysis from the previous sections shows that the complete similitude in the lab simulation does not require the adoption of a fluid the same as the drilling fluid circulating in the wellbore. FIG. 4 shows the influence of whether the same fluid is used between lab and field on the value of $Q_L/Q_F$ and $\omega_L/\omega_F$ for a power-law field ($\tau_{0,L}=\tau_{0,F}=0$). FIG. 4A shows the variation of $Q_L/Q_F$ and $\omega_L/\omega_F$ when exactly same fluid is used in the lab and field. FIG. 4B corresponds to the case that the lab and field conditions each uses different fluid types, and $\rho_L/\rho_F=K_L/K_F=0.8$. As can be seen, FIG. 4A and FIG. 4B represent same results. This means the usage of dissimilar fluids in lab and field conditions can produce the same $Q_L/Q_F$ and $\omega_L/\omega_F$ compared to the case when the same fluid is used, as long as the value of $\rho_L/\rho_F$ and $K_L/K_F$ are equal. However, as depicted in FIG. 4C, when value of $\rho_L/\rho_F$ and $K_L/K_F$ are not equal, the results of $Q_L/Q_F$ and $\omega_L/\omega_F$ are significantly different from the previous two cases.

The ratios $Q_r=Q_L/Q_p$, $\omega_r=\omega_L/\omega p_i$ and $\tau_{0,r}=\tau_{0,L}/\tau_{0,F}$ are the main design parameters of the laboratory-scale model device. The following equation may be obtained by evaluating the ratios between Eqs. (39) and (42):

$$\frac{Q_r}{\omega_r}=\psi^3. \tag{44}$$

The same equation can also be obtained by dividing Eq. (9) with Eq. (10). Therefore, the equation applies to all fluid rheology types.

Equation (44) denotes a compromise between the flow rate $Q_L$ and inner pipe rotation speed $\omega_M$ if the objective is to keep the flow loop device size in check. That is to say that a small model device (small) would require small $Q_L$ and large $\omega_L$. The former is a favorable factor in designing the laboratory setup since it allows for using a smaller pump. The latter, however, could impose practical restrictions on the size of the flow loop device since the rotation speed of the device inner pipe cannot grow arbitrarily large.

An aspect of the conducted dimensional analysis is to properly select the fluid rheology of the experimental model. The dimensional analysis presented in the previous section indicates that the scaling of the equations for the flow of a yield-power law fluid is generally possible. However, such a scaling requires using a different fluid in the laboratory model than the prototype. A potential challenge of such a scaling practice for yield power-law fluids is that the relations among the fluid rheological parameters—k, n and $\tau_0$—are rather entangled. Existing predictive models for such relations are scant in the literature.

A mathematical problem can be formulated in order to obtain the optimal values of a similitude design. By taking the logarithm of Eqs. (39), (40), and (41), the following linear system of equations can be obtained $$\begin{bmatrix}\log\tau_{0r}\\ \log\omega_r\\ \log Q_r\end{bmatrix}=\frac{1}{2-n}\begin{bmatrix}2n & 2 & -2\\ -2 & 1 & -1\\ 4-3n & 1 & -1\end{bmatrix}\cdot\begin{bmatrix}\log\psi\\ \log K_r\\ \log\rho_r\end{bmatrix}, \tag{49}$$

where the subscript r denotes the ratio of a laboratory model value to the corresponding prototype value, e.g., $$\omega_r=\frac{\omega_L}{\omega_F}.$$

If a similitude design based on selected values of ($\omega$, $K_r$, $\rho_r$) is considered, the set of values for $\tau_{0r}$, $\omega_r$ and $Q_r$ can be obtained correspondingly. A practical challenge of such a design is that the rheological set of parameters $\rho$, $\tau_0$ and K are interdependent through the designed fluid chemistry, not the scaling laws of mechanics. Therefore, it is not straightforward, if even possible, to adjust the yield stress of a fluid after the other rheological properties (K, $\rho$, n) are set at given values. Resultingly, a similitude design based solely on the fluid rheology appears to be more feasible. In this aspect, the following rearrangement of the matrix relation in Eq. (49) is considered:

$$\begin{bmatrix}\log\psi\\ \log\omega_r\\ \log Q_r\end{bmatrix}=\frac{1}{2n}\begin{bmatrix}-(2-n) & 2 & -n\\ 2 & -2 & 0\\ -(4-3n) & 4 & -3n\end{bmatrix}\cdot\begin{bmatrix}\log\tau_{0r}\\ \log K_r\\ \log\rho_r\end{bmatrix}. \tag{50}$$

From an operational standpoint, the experimental model design aims at minimizing the geometric ratio $\psi$ and laboratory flow rate $Q_L$. The rotational speed $\omega_L$ is constrained by an upper threshold based on the available motor speeds and consideration of the inner pipe vibrations. Given the designed fluid chemistry, certain box constraints for rheological quantities ($\tau_{0,L}$, $K_L$, $\rho_L$) may apply. The optimization problem at hand may be mathematically formulated as follows. The objective is to find a vector x=[log $\tau_{0r}$ log $K_r$ log $\rho_r$]$^T$ that minimizes $$f(x)=\beta\log\psi+(1-\beta)\log Q_r=\frac{1}{2n}[\beta\ \ (1-\beta)]\cdot\begin{bmatrix}-(2-n) & 2 & -n\\ -(4-3n) & 4 & -3n\end{bmatrix}\cdot x, \tag{51}$$

when subjected to the following constraint for the inner pipe speed, $$\log\omega_r=\frac{1}{2n}[2\ \ -2\ \ 0]\cdot x\le\log\omega_{r,max}, \tag{52}$$

and a set of box constraints for fluid rheology parameters, including $$x_{min}\le x\le x_{max}, \tag{53}$$

in which $$x_{min} = [\log \tau_{0r,min} \quad \log K_{r,min} \quad \log \rho_{r,min}]^T \tag{54}$$

and $$x_{max} = [\log \tau_{0r,max} \quad \log K_{r,max} \quad \log \rho_{r,max}]^T. \tag{55}$$

The quantity $\beta$ in Eq. (51) is a weighting factor for this optimization (39). Linear programming (40) can be applied to obtain the solution to optimization problem as outlined by Eqs. (51) to (55). The solution is independent of the weighting parameter $\beta$, which can be expressed as follows, $$x = [\log\{\min[K_{r,min}\omega_{r,max}^n, \tau_{0r,max}]\} \quad \log K_{r,min} \quad \log \rho_{r,max}]^T. \tag{56}$$

Substitution of Eq. (56) into Eq. (50) yields $$\psi_{min} = \begin{cases} \omega_{r,max}^{-n}\left(\frac{K_{r,min}}{\rho_{r,max}}\right)^{\frac{(2-n)}{2n}} & K_{r,min}\omega_{r,max}^n < \tau_{r,max} \\ \frac{K_{r,min}^{1/n}}{\tau_{r,max}^{1/2}\rho_{r,max}^{[(2-n)/2n]}} & K_{r,min}\omega_{r,max}^n \geq \tau_{r,max} \end{cases}. \tag{57}$$

Consequently, substituting Eq. (57) in Eq. (44) determines the model flow rate as follows:

$$Q_{L,min} = \left(\frac{\psi_{min}^3\omega_{L,max}}{\omega_F}\right)Q_F. \tag{58}$$

Figure 5:
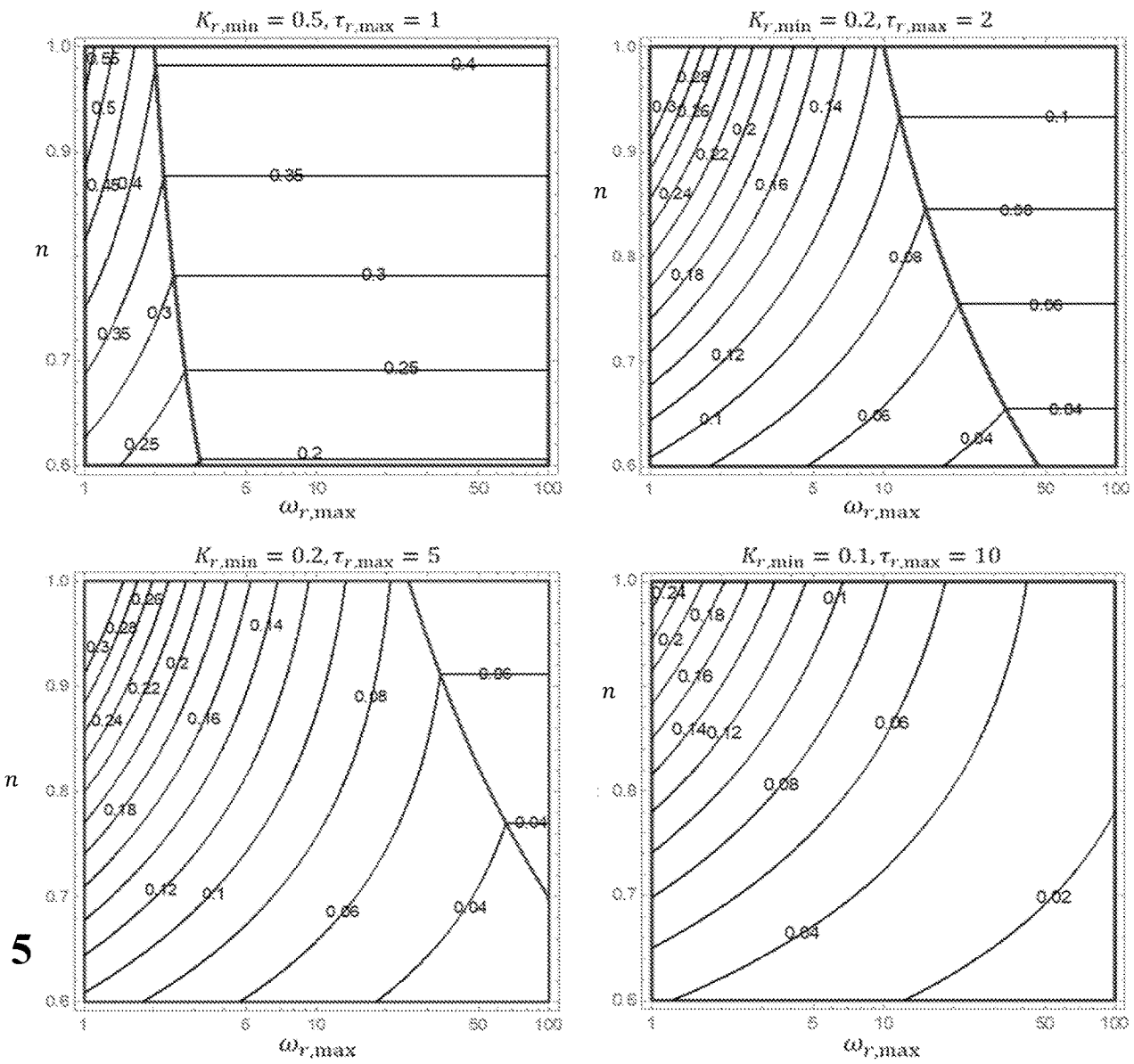
FIG. 5 shows contour plots of the optimized solution for minimum scaling ratio $\psi=R_{o_L}/R_{o_F}$ as a function of pipe rotation speed on a log scale on the horizontal axis and fluid power index n on the vertical axis. Here, $\rho_{max}=1.5$.

FIG. 5 displays the optimized solution given by Eq. (57). The horizontal axis in the plots is the maximum rotational speed ratio $\omega_{r,max}$, while the vertical axis denotes the fluid power index n. The assumed values for the consistency index ratio $K_{r,min}$ and the yield stress ratio $\tau_{0r,max}$ of each plot are displayed. The inner red boundary within the plots represents the locus of discontinuity points on each contour curve. This boundary can be represented by the following equation:

$$\omega_{r,max} = \left(\frac{\tau_{r,max}}{K_{r,min}}\right)^{1/n}. \tag{59}$$

FIG. 5 demonstrates that a higher rotational speed and a smaller power index allows for selecting a smaller scaling ratio, $\psi$. However, if the rotational speed reaches the threshold defined by Eq. (54), the minimum scaling ratio is only a function of the fluid power index.

Dimensional analysis is used to develop a series of scaling formulae between the pressure loss gradients of fully developed annular flows in a wellbore and a laboratory flow loop. Analytical solutions of the appropriate lab fluid pumping rate, lab inner pipe rotation speed, and fluid rheology to achieve a full similitude between the two flows, as well as the corresponding expected pressure gradients in the wellbore in terms of the pressure gradients measured in the laboratory were derived. The below conclusions are drawn:

1. For all the considered fluid types, the appropriate values for $Q_L$ and $\omega_L$ have a linear relationship with $Q_F$ and $\omega_F$. The proportionality depends on the length ratio $\psi$, density ratio $\rho_L/\rho_F$, consistency index ratio $K_L/K_F$, and power index n.
2. The expressions of $Q_L$ and $\omega_L$ for the yield power-law fluid are exactly the same as the power-law fluid. However, the complete similitude requires an additional constraint on the yield stress $\tau_{0,L}$ of the lab fluid.
3. For the non-Newtonian fluids, the value of $Q_L/Q_F$ increases with the decrease of $\rho_L/\rho_F$, or the increase of $\psi$, $K_L/K_F$, and n. $\omega_L/\omega_F$ grows larger with the increase of $K_L/K_F$ and n, or the decrease of $\rho_L/\rho_F$ and $\psi$.
4. The value of $\omega_L$ for the typical lab condition is usually much larger than $\omega_F$. It is suggested to use a fluid with a small consistency index or a large density for the lab simulation to avoid the need for a practically nonviable $\omega_L$.
5. The derived formulae reveals that a complete similitude does not necessarily mean that the lab simulation should use the same fluid as the field condition.

The following references are incorporated herein by reference in their entirety.

(1) Aadnoy, B., Cooper, I., Miska, S. Z., Mitchell, F., & Payne, M. L. (2009). Advanced Drilling and Well Technology, Society of Petroleum Engineers, Richardson, TX.
(2) Azouz, I., Shirazi, S. A., Pilehvari, A., & Azar, J. J. (1993). Numerical simulation of laminar flow of yield-power-law fluids in conduits of arbitrary cross-section. Journal of Fluids Engineering, Transactions of the ASME, 115(4), 710-716.
(3) Fredrickson, A., & Bird, R. B. 1958. Ind. Eng. Chem., 50(3), 347-352.
(4) Hanks, R. W., & Larsen, K. M. (1979). The Flow of Power-law Non-Newtonian Fluids in Concentric Annuli. Industrial and Engineering Chemistry Fundamentals, 18(1), 33-35.
(5) Luo, Y., & Peden, J. M. (1987). Flow of drilling fluids through eccentric annuli. 389-396.
(6) Shchipanov, P. K. (1949). Flow of viscoplastic material in the concentric space between two coaxial tubes. J. Tech. Phys., 19 (10), 1.
(7) Volarovich, M. P., & Gutkin, A. M. (1946). Flow of plastic-viscoplastic material between two parallel flat-walls and in annular space between two coaxial tubes. J. Tech. Phys, 16(3), 321.
(8) Deterre, R., Nicoleau, F., Lin, Q., Allanic, N., & Mousseau, P. (2020). The flow of power-law fluids in concentric annuli: A full analytical approximate solution. Journal of Non-Newtonian Fluid Mechanics, 285.
(9) Escudier, M. P. (2002). Fully developed laminar flow of purely viscous non-Newtonian liquids through annuli, including the effects of eccentricity and inner-cylinder rotation. 23, 52-73.
(10) Dosunmu, I. T., & Shah, S. N. (2015a). Annular flow characteristics of pseudoplastic fluids. Journal of Energy Resources Technology, Transactions of the ASME, 137 (4). https://doi.org/10.1115/1.4030106
(11) Dosunmu, I. T., & Shah, S. N. (2015b). Pressure drop predictions for laminar pipe flow of carreau and modified power law fluids. Canadian Journal of Chemical Engineering, 93(5), 929-934.
(12) Filip, P., & David, J. (2003). Axial Couette-Poiseuille flow of power-law viscoplastic fluids in concentric annuli. Journal of Petroleum Science and Engineering, 40(3-4), 111-119.
(13) 16. Filip, P., & David, J. (2008). IN CONCENTRIC ANNULI—LIMITING CASES. 3, 3-6.

(14) Escudier, M. P., Gouldson, I. W., Oliveira, P. J., & Pinho, F. T. (2000). Effects of inner cylinder rotation on laminar flow of a Newtonian fluid through an eccentric annulus. International Journal of Heat and Fluid Flow, 21(1), 92-103.

(15) Guckes, T. L. (1975). Laminar Flow of Non-Newtonian Fluids in an Eccentric Annulus. TRANS. ASME, 97, 498-506.

(16) Haciislamoglu, M., & Langlinais, J. (1990). Non-Newtonian Flow in Eccentric Annuli. Journal of Energy Resources Technology, Transactions of the ASME, 112 (3), 163-169. https://doi.org/10.1115/1.2905753

(17) Haciislamoglu, Mustafa, & Cartalos, U. (1994). Practical pressure loss predictions in realistic annular geometries. Proceedings—SPE Annual Technical Conference and Exhibition, Delta, 113-126. https://doi.org/10.2523/28304-ms

(18) Hussain, Q. E., & Sharif, M. A. R. (1998). Analysis of yield-power-law fluid flow in irregular eccentric annuli. Journal of Energy Resources Technology, Transactions of the ASME, 120(3), 201-207. https://doi.org/10.1115/1.2795036

(19) Dokhani, V., Ma, Y., Li, Z., Geng, T., & Yu, M. (2020). Effects of drill string eccentricity on frictional pressure losses in annuli. Journal of Petroleum Science and Engineering, 187 (March 2019). https://doi.org/10.1016/j.petrol.2019.106853

(20) Tong, T. A., Yu, M., Ozbayoglu, E., & Takach, N. (2020). Numerical simulation (20) of non-Newtonian fluid flow in partially blocked eccentric annuli. Journal of Petroleum Science and Engineering, 193 (May).

(21) Erge, O., Ozbayoglu, M. E., Miska, S. Z., Yu, M., Takach, N., Saasen, A., & May, R. (2014). Effect of Drillstring Deflection and Rotary Speed on Annular Frictional Pressure Losses. Journal of Energy Resources Technology, 136(4), 1-10. https://doi.org/10.1115/1.4027565

(22) Erge, O., Vajargah, A. K., Ozbayoglu, M. E., & Van Oort, E. (2016). Improved ECD prediction and management in horizontal and extended reach wells with eccentric drillstrings. SPE—International Association of Drilling Contractors Drilling Conference Proceedings, 2016-January. https://doi.org/10.2118/178785-ms

(23) Escudier, M. P., Oliveira, P. J., & Pinho, F. T. (2002). Fully developed laminar flow of purely viscous non-Newtonian liquids through annuli, including the effects of eccentricity and inner-cylinder rotation. International Journal of Heat and Fluid Flow, 23(1), 52-73.

(24) Vieira Neto, J. L., Martins, A. L., Ataíde, C. H., & Barrozo, M. A. S. (2012). Non-newtonian flows in annuli with variable eccentric motion of the inner tube. Chemical Engineering and Technology, 35(11), 1981-1988.

(25) Wan, S., Morrison, D., & Bryden, I. G. (2000). The flow of Newtonian and inelastic non-Newtonian fluids in eccentric annuli with inner-cylinder rotation. Theoretical and Computational Fluid Dynamics, 13(5), 349-359.

(26) Haige, W., Yinao, S., Yangmin, B., Zhenguo, G., & Fengmin, Z. (2007). Experimental Study of Slimhole Annular Pressure Loss and Its Field Applications.

(27) Silva, M., & Shah, S. (2000). Friction Pressure Correlations of Newtonian and Non-Newtonian Fluids through Concentric and Eccentric Annuli.

(28) Zamora, M., Roy, S., & Slater, K. (2005). Comparing a Basic Set of Drilling Fluid Pressure-Loss Relationships to Flow-Loop and Field Data. AADE National Technical Conference and Exhibition.

(29) Erge, O., Ozbayoglu, E. M., Miska, S. Z., Yu, M., Takach, N., Saasen, A., & May, R. (2015). Laminar to turbulent transition of yield power law fluids in annuli. Journal of Petroleum Science and Engineering, 128, 128-139.

(30) Majidi, R., Miska, S. Z., Ahmed, R., Yu, M., & Thompson, L. G. (2010). Radial flow of yield-power-law fluids: Numerical analysis, experimental study and the application for drilling fluid losses in fractured formations. Journal of Petroleum Science and Engineering, 70(3-4), 334-343.

(31) Tang, M., Ahmed, R., & He, S. (2016). Modeling of yield-power-law fluid flow in a partially blocked concentric annulus. Journal of Natural Gas Science and Engineering, 35, 555-566.

(32) Kelessidis, V. C., Dalamarinis, P. and Maglione, R., 2011. J Petrol Sci Eng, 77(3-4), 305-312.

(33) Erge, O., Ozbayoglu, E. M., et al., 2015. SPE Drill Completion, 30(03), 257-271.

(34) Rehm, B., Schubert, J., et al. 2013. Managed Pressure Drilling. Elsevier.

(35) Yamada, Y., 1962. Bull JSME, 5(18), 302-310.

(36) Escudier, M. P., Oliveira, P. J., and Pinho, F. T., 2002, Int. J. Heat Fluid Flow, 23, 52-73.

(37) Hanks, R. W. (1963). The laminar-turbulent transition for fluids with a yield stress. AIChE Journal, 9(3), 306-309.

(38) Csizmadia, P., Hös, C. (2013). Predicting the friction factor in straight pipes in the case of Bingham plastic and the power-law fluids by means of measurements and CFD simulation. Periodica Polytechnica Chemical Engineering, 57(1-2), 79-83.

(39) Deb, K., 2014. Multi-objective optimization, Search methodologies, Springer, 2014.

(40) Vanderbei, R. J., 2015. Linear Programming, Foundations and Extensions, Springer London, United Kingdom, 2015.

It should be understood that the disclosure of a range of values is a disclosure of every numerical value within that range, including the end points. It should also be appreciated that some components, features, and/or configurations may be described in connection with only one particular embodiment, but these same components, features, and/or configurations can be applied or used with many other embodiments and should be considered applicable to the other embodiments, unless stated otherwise or unless such a component, feature, and/or configuration is technically impossible to use with the other embodiment. Thus, the components, features, and/or configurations of the various embodiments can be combined together in any manner and such combinations are expressly contemplated and disclosed by this statement.

It will be apparent to those skilled in the art that numerous modifications and variations of the described examples and embodiments are possible considering the above teachings of the disclosure. The disclosed examples and embodiments are presented for purposes of illustration only. Other alternate embodiments may include some or all of the features disclosed herein. Therefore, it is the intent to cover all such modifications and alternate embodiments as may come within the true scope of this invention, which is to be given the full breadth thereof.

It should be understood that modifications to the embodiments disclosed herein can be made to meet a particular set of design criteria. Therefore, while certain exemplary embodiments of the devices, systems, and methods of using and making the same disclosed herein have been discussed and illustrated, it is to be distinctly understood that the invention is not limited thereto but may be otherwise variously embodied and practiced within the scope of the following claims.

What is claimed is:

1. A flow loop system for estimating wellbore bottomhole pressure or circulation density, comprising:

an eccentric annulus structure, comprising an inner eccentric and rotating pipe and an outer pipe, the inner eccentric pipe representative of a drill string in a wellbore, the outer pipe representative of the wellbore;

a pressure sensor configured to measure pressure loss gradients of annular flows between the inner eccentric pipe and the outer pipe; and a wellbore circulation density processing module configured to estimate the wellbore's bottomhole pressure based on the measured loss gradients of annular flows, fluid flow rate, particle injection rate, rotation speed of the inner eccentric pipe, and eccentricity of the inner eccentric pipe.

2. The flow loop system of claim 1, wherein the wellbore circulation density processing module is configured to use fluid flow rate within the flow loop system and inner eccentric pipe rotation speed to mimic annular flow of drilling fluid in the wellbore and drill pipe rotational speed in the wellbore.

3. The flow loop system of claim 2, wherein the estimation of the wellbore's bottomhole pressure involves imposing geometric, kinematic, dynamic, and rheological similarities between fluid and solid particles flow within the flow loop system and annular flow of the wellbore such that Fanning friction factors in the flow loop system are identical to Fanning friction factors in the wellbore.

4. The flow loop system of claim 3, wherein the wellbore circulation density processing module is configured to impose geometric, kinematic, dynamic, and rheological similarities simultaneously.

5. The flow loop system of claim 3, wherein imposing geometric similarities involves requiring length ratios between fluid flow within the flow loop system and annular flow of the wellbore to be identical.

6. The flow loop system of claim 5, wherein requiring length ratios between fluid flow within the flow loop system and annular flow of the wellbore to be identical involves:

$$\frac{R_{i,L}}{D_{H,L}} = \frac{R_{i,F}}{D_{H,F}} \text{ and } \frac{e_L}{D_{H,L}} = \frac{e_F}{D_{H,F}};$$

$R_o$ and $R_i$ are radii of the inner eccentric pipe and the outer pipe, respectively;

e is drill pipe eccentricity;

$D_H$ denotes effective hydraulic diameter for fluid flow, wherein $D_H=\alpha(R_o-R_i)$ with $\alpha$ being a dimensionless value between 1 and 2; and L and F denote corresponding parameters of fluid flow within the flow loop system and annular flow of the wellbore, respectively.

7. The flow loop system of claim 3, wherein imposing kinematic similarities involves requiring a ratio of velocities attributed to the inner eccentric pipe rotation and a pump flow rate to equate to a ratio of velocities attributed to drill pipe rotational speed in the wellbore and annular flow of drilling fluid in the wellbore.

8. The flow loop system of claim 7, wherein requiring the ratio of velocities attributed to the inner eccentric pipe rotation and the pump flow rate to equate to the ratio of velocities attributed to drill pipe rotational speed in the wellbore and annular flow of drilling fluid in the wellbore involves:

$$\eta = \frac{\omega_L R_{i,L}}{U_L} = \frac{\omega_F R_{i,F}}{U_F};$$

U is axial velocity of the fluid during annular flow, which can be calculated as:

$$U = \frac{Q}{\pi(R_o^2 - R_i^2)};$$

Q is volumetric pumping rate of the fluid and particles mixture;

$R_o$ and $R_i$ are radii of the inner eccentric pipe and the outer pipe, respectively;

$\omega$ is angular velocity of the inner eccentric pipe; and

L and F denote corresponding parameters of fluid flow within the flow loop system and annular flow of the wellbore, respectively.

9. The flow loop system of claim 3, wherein imposing dynamic similarities involves requiring the Reynolds number, Taylor number, Froude number, and Buoyancy number of the flow within the flow loop system to be equal to the corresponding dimensionless values of the annular flow of the wellbore.

10. The flow loop system of claim 9, wherein requiring the Reynolds number, Taylor number, Froude number, and Buoyancy number of the fluid flow within the flow loop system to be equal to the corresponding dimensionless values of the annular flow of the wellbore involves:

$$\left(\frac{\rho U D_H}{\mu}\right)_L = \left(\frac{\rho U D_H}{\mu}\right)_F \text{ and } \left(\frac{\rho \omega R_i D_H}{\mu}\right)_L = \left(\frac{\rho \omega R_i D_H}{\mu}\right)_F;$$

$$\left(\frac{\rho_f V_{sl} D_S}{\mu_{fl}}\right)_L = \left(\frac{\rho_f V_{sl} D_S}{\mu_{fl}}\right)_F \text{ and } \left(\frac{\rho_s}{\rho_f}\right)_L = \left(\frac{\rho_s}{\rho_f}\right)_F$$

$\rho_s$ the density of solids;

$\rho_f$ the density of fluid;

$D_s$ is the solid particle or cutting size;

$\mu_{fl}$ is the viscosity of fluid;

$V_{sl}$ is the slip velocity of the particles or drill cuttings;

$\mu$ is effective viscosity of the mixture;

$\mu_{fl}$ is the effective viscosity of the fluid;

$\omega$ is angular velocity of the inner eccentric pipe;

U is axial velocity of the fluid during annular flow, which can be calculated as:

$$U = \frac{Q}{\pi(R_o^2 - R_i^2)};$$

Q is volumetric fluid pumping rate;

$R_o$ and $R_i$ are radii of the inner eccentric pipe and the outer pipe, respectively;

$D_H$ denotes effective hydraulic diameter for fluid flow, wherein $D_H=\alpha(R_o-R_i)$ with $\alpha$ being a dimensionless value between 1 and 2; and L and F denote corresponding parameters of fluid flow within the flow loop system and annular flow of the wellbore, respectively.

11. The flow loop system of claim 9, wherein requiring the Froude number and the Buoyancy number of a particulate solid material within the flow loop system to be equal to the Froude number and the Buoyancy number of the annular flow of the wellbore involves:

$$\left(\frac{\rho_f V_{sl} D_S}{\mu_{fl}}\right)_L = \left(\frac{\rho_f V_{sl} D_S}{\mu_{fl}}\right)_F \text{ and } \left(\frac{\rho_s}{\rho_f}\right)_L = \left(\frac{\rho_s}{\rho_f}\right)_F$$

$\rho_s$ is the density of solids;
$\rho_f$ the density of fluid;
$D_s$ is the solid particle or cutting size;
$\mu_{fl}$ is the viscosity of fluid; and
$V_{sl}$ is the slip velocity of the particles or drill cuttings.

12. The flow loop system of claim 1, wherein:
the eccentric annulus structure comprises:
the inner eccentric pipe configured as a rotor;
the outer pipe configured as a stator;
a pump configured to circulate fluid through the eccentric annulus structure;
a variable speed motor in mechanical connection with the inner eccentric pipe; and
a feeder configured to inject particulate material into the circulating fluid.

13. The flow loop system of claim 12, wherein the particulate material is selected to mimic drill cutting material.

14. A method for estimating wellbore bottomhole pressure or circulation density via a flow loop system comprising: an eccentric annulus structure having an inner eccentric and rotating pipe and an outer pipe, the inner eccentric pipe representative of a drill string in a wellbore, the outer pipe representative of the wellbore; a pressure sensor configured to measure pressure loss gradients of annular flows between the inner eccentric pipe and the outer pipe; and a wellbore circulation density processing module configured to estimate the wellbore's bottomhole pressure based on the measured loss gradients of annular flows, rotation of the inner eccentric pipe, and eccentricity of the inner eccentric pipe, as well as the fluid and solid particles flow rates, the method comprising:
measuring pressure loss gradients of annular flows between the inner eccentric pipe and the outer pipe; and
estimating the wellbore's bottomhole pressure based on the measured loss gradients of annular flows, flow rates, rotation of the inner eccentric pipe, and eccentricity of the inner eccentric pipe, as well as the fluid and solid particles flow rates.

15. The method of claim 14, further comprising using fluid and particulate solid flow rates within the flow loop system and inner eccentric pipe rotation speed to mimic annular flow of drilling fluid and cuttings in the wellbore and drill pipe rotational speed in the wellbore.

16. The method of claim 15, further comprising imposing geometric, kinematic, and dynamic similarities between fluid flow within the flow loop system and annular flow of the wellbore such that Fanning friction factors in the flow loop system are identical to Fanning friction factors in the wellbore.

17. The method of 16, wherein:
imposing geometric similarities involves requiring length ratios between mixture flow within the flow loop system and annular flow of the wellbore to be identical;
imposing kinematic similarities involves requiring a ratio of velocities attributed to the inner eccentric pipe rotation and a pump flow rate to equate to a ratio of velocities attributed to drill pipe rotational speed in the wellbore and annular flow of drilling fluid in the wellbore; and
imposing dynamic similarities involves requiring the Reynolds number and the Taylor number of the fluid flow within the flow loop system to be equal to the Reynolds number and the Taylor number of the annular flow of the wellbore.

18. The method of claim 15, wherein imposing geometric, kinematic, dynamic, and rheological similarities is done simultaneously.

19. The method of claim 14, wherein the eccentric annulus structure comprises: the inner eccentric pipe configured as a rotor; the outer pipe configured as a stator; a pump configured to circulate fluid through the eccentric annulus structure; a variable speed motor in mechanical connection with the inner eccentric pipe; and a feeder configured to inject particulate material into the circulating fluid, the method further comprises:
circulating fluid through the eccentric annulus structure; and
injecting the particulate material into the circulating fluid.

20. The method of claim 19, wherein the particulate material is selected to mimic drill cutting material.

* * * * *